US012497209B2

(12) United States Patent
Sekowski et al.

(10) Patent No.: US 12,497,209 B2
(45) Date of Patent: Dec. 16, 2025

(54) COLLAPSIBLE CRATE WITH TRANSLATING HINGE

(71) Applicant: Rehrig Pacific Company, Los Angeles, CA (US)

(72) Inventors: Daniel Vincent Sekowski, Loganville, GA (US); William P. Apps, Alpharetta, GA (US)

(73) Assignee: Rehrig Pacific Company, Monterey Park, CA (US)

( * ) Notice: Subject to any disclaimer, the term of this patent is extended or adjusted under 35 U.S.C. 154(b) by 591 days.

(21) Appl. No.: 17/851,567

(22) Filed: Jun. 28, 2022

(65) Prior Publication Data

US 2023/0002111 A1 Jan. 5, 2023

Related U.S. Application Data

(60) Provisional application No. 63/218,269, filed on Jul. 2, 2021.

(51) Int. Cl.
*B65D 6/18* (2006.01)
*B65D 21/08* (2006.01)

(52) U.S. Cl.
CPC ..... *B65D 11/184* (2013.01); *B65D 21/086* (2013.01)

(58) Field of Classification Search
CPC ... B65D 11/18; B65D 11/184; B65D 11/1833; B65D 88/52; B65D 2519/009
See application file for complete search history.

(56) References Cited

U.S. PATENT DOCUMENTS 2,780,381 A 2/1957 Coit, Jr.
3,360,180 A 12/1967 Venturi
3,372,829 A 3/1968 Averill
(Continued)

FOREIGN PATENT DOCUMENTS

DE 3500427 A1 7/1986
DE 9203114 U1 5/1992
(Continued)

OTHER PUBLICATIONS

U.S. Appl. No. 17/474,728.
(Continued)

*Primary Examiner* — Andrew T Kirsch
(74) *Attorney, Agent, or Firm* — Carlson, Gaskey & Olds, P.C.

(57) ABSTRACT

A collapsible container includes a base including a first cam surface, a second cam surface, and a third cam surface. A hinge permits vertical translation of a wall relative to the base. The wall includes a first follower, a second follower, and a third follower, wherein the first follower is configured to contact the first cam surface during a first angular interval, wherein the second follower is configured to contact the second cam surface during a second angular interval, and wherein the third follower is configured to contact the third cam surface during a third angular interval. A retractable wall may include a pair of vertical portions defining an opening therebetween. An upper portion and a lower portion may be pivotably connected to the pair of vertical portions. A link having an arm may be pivotably connected to the upper portion and pivotably connected to the lower portion.

27 Claims, 35 Drawing Sheets

(56) References Cited

U.S. PATENT DOCUMENTS

| | | | | |
|---|---|---|---|---|
| 3,835,792 | A | 9/1974 | Wharton | |
| 3,941,271 | A * | 3/1976 | Zarges | B65D 7/26 220/6 |
| 3,981,410 | A | 9/1976 | Schurch | |
| 4,023,698 | A | 5/1977 | Joseph | |
| 4,043,476 | A | 8/1977 | Joseph | |
| 4,406,380 | A | 9/1983 | Paige | |
| 4,662,532 | A | 5/1987 | Anderson et al. | |
| 4,674,647 | A | 6/1987 | Gyenge et al. | |
| 4,765,480 | A | 8/1988 | Malmanger | |
| 5,016,772 | A | 5/1991 | Wilk | |
| 5,161,709 | A | 11/1992 | Oestreich, Jr. | |
| 5,467,885 | A * | 11/1995 | Blinstrub | B65D 11/18 220/6 |
| 5,555,980 | A | 9/1996 | Johnston et al. | |
| 5,562,224 | A | 10/1996 | Pascal et al. | |
| 5,660,291 | A | 8/1997 | Dash | |
| 6,015,056 | A | 1/2000 | Overholt et al. | |
| 6,044,998 | A | 4/2000 | Schearer et al. | |
| 6,056,177 | A | 5/2000 | Schneider | |
| 6,098,827 | A | 8/2000 | Overholt et al. | |
| 6,209,742 | B1 | 4/2001 | Overholt et al. | |
| 6,290,081 | B1 | 9/2001 | Merey | |
| 6,305,566 | B1 | 10/2001 | Pigott et al. | |
| 6,409,041 | B1 * | 6/2002 | Overholt | B65D 11/1833 220/669 |
| 6,460,717 | B1 | 10/2002 | Smyers et al. | |
| 6,601,724 | B1 | 8/2003 | Koefelda et al. | |
| 6,691,885 | B2 | 2/2004 | Brown | |
| 6,918,502 | B1 | 7/2005 | Overholt et al. | |
| 7,011,225 | B2 | 3/2006 | Oster et al. | |
| 7,048,135 | B2 | 5/2006 | Smyers et al. | |
| 7,264,122 | B2 | 9/2007 | Koefelda et al. | |
| 8,381,929 | B2 * | 2/2013 | Kellerer | B65D 11/1833 206/600 |
| 8,567,634 | B2 * | 10/2013 | Huizingh | B65D 11/1833 220/4.23 |
| 8,863,971 | B2 | 10/2014 | Cavalcante et al. | |
| 2002/0070215 | A1 | 6/2002 | Walsh et al. | |
| 2003/0000950 | A1 | 1/2003 | Murakami et al. | |
| 2004/0020821 | A1 | 2/2004 | Koefelda et al. | |
| 2004/0200833 | A1 | 10/2004 | Dubois et al. | |
| 2006/0231555 | A1 | 10/2006 | Smyers et al. | |
| 2006/0260976 | A1 | 11/2006 | Apps | |
| 2007/0158345 | A1 | 7/2007 | Booth et al. | |
| 2009/0134157 | A1 | 5/2009 | Meers | |
| 2022/0097905 | A1 | 3/2022 | Apps et al. | |

FOREIGN PATENT DOCUMENTS

| | | | |
|---|---|---|---|
| DE | 9305904 | U1 | 8/1993 |
| DE | 4319099 | A1 | 12/1994 |
| DE | 20101630 | U1 | 4/2001 |
| EP | 0690003 | A1 | 1/1996 |
| EP | 0785142 | A1 | 7/1997 |
| EP | 1225131 | A1 | 7/2002 |
| EP | 1524170 | A2 | 4/2005 |
| EP | 1935792 | A1 | 6/2008 |
| EP | 2062827 | A1 | 5/2009 |
| FR | 1227059 | A | 8/1960 |
| FR | 2810020 | A1 | 12/2001 |
| GB | 2357078 | A | 6/2001 |
| GB | 2360762 | A | 10/2001 |
| GB | 2431922 | A | 5/2007 |
| GB | 2449502 | A | 11/2008 |
| WO | 9521773 | A1 | 8/1995 |
| WO | 9840199 | A1 | 9/1998 |
| WO | 03008275 | A2 | 1/2003 |
| WO | 2006010311 | A1 | 2/2006 |
| WO | 2008145977 | A1 | 12/2008 |

OTHER PUBLICATIONS

U.S. Appl. No. 17/459,683.
Examination Report for Australian Application No. 2022204676 dated Sep. 19, 2025.

* cited by examiner

FRONT

BACK

FRONT

BACK

COLLAPSIBLE CRATE WITH TRANSLATING HINGE

BACKGROUND

Collapsible containers generally include a base, a pair of opposed long walls connected to long edges of the base and pivotable between a collapsed position on the base and an upright, use position. A pair of opposed short walls are connected to short edges of the base and are pivotable between a collapsed position on the long walls on the base and an upright use position.

The long walls are longer than the short walls, such that the long walls will overlap one another when collapsed (because the long walls are closer to one another) and the short walls do not overlap one another. In some collapsible containers, when the second long wall is collapsed onto the first long wall, it will not be parallel to the base, which will increase the height of the collapsed container.

In some collapsible containers, one of the long walls is pivotably connected to the base about an axis that is higher than the other, such that lower-axis long wall must be collapsed onto the base and the higher-axis long wall must be collapsed onto the lower-axis long wall. This provides flat, collapsed long walls, but requires a particular sequence of collapsing the two long walls.

Some collapsible containers provide long walls with hinges that are also vertically translatable such that either long wall can be collapsed directly onto the base and either long wall can be collapsed onto the first long wall and in either sequence, both long walls will be parallel to the base. In other words, the long walls can be collapsed in either sequence. This provides a compact volume when collapsed, but the vertically translatable hinges do not always pivot and slide smoothly, especially when moving from the collapsed position directly on the base to the upright position.

The assignee of the present application has developed a series of containers with at least one retractable wall through which product in the container can be retrieved even while other containers are stacked thereon. For example, such a container may be filled with cartons of eggs. A stack of such containers could be loaded into a refrigerator of a store. While stacked, the front walls of the containers could be retracted, providing customers with access to the egg cartons in the containers without the need to unload the containers. The containers may be collapsible, such that when they are empty, they can be collapsed to an efficient volume for storage and return to the warehouse for reuse.

In some retractable wall designs, the retractable wall includes a plurality of wall portions that are pivotable outward to provide access to the interior. To retract the wall, the user releases a latch and then pivots an upper portion outward. This causes one or more lower portions to pivot outward as well. It is desirable for this motion to be smooth, without binding.

SUMMARY

An improved vertically translatable hinge is disclosed herein. The improved hinge could be used with any collapsible container, with or without one or more retractable walls.

An improved retractable wall for a container is also disclosed herein. The retractable wall proves a smoother, more reliable retracting motion. The retractable wall could be used with a collapsible container or a non-collapsible container.

Some of the features described herein relate to a collapsible container including a base and a first wall. The base includes a first cam surface, a second cam surface, and a third cam surface. The first wall is pivotably connected to the base by a hinge and is pivotable through first, second and third angular intervals between a collapsed position on the base and an upright position. The hinge permits vertical translation of the first wall relative to the base. The first wall including a first follower, a second follower, and a third follower, wherein the first follower is configured to contact the first cam surface during the first angular interval, the second follower is configured to contact the second cam surface during the second angular interval, and the third follower is configured to contact the third cam surface during the third angular interval.

The first follower may be configured not to contact the first cam surface during at least a portion of the second angular interval. The second follower may be configured not to contact the second cam surface during at least a portion of the third angular interval.

When the first wall is moved from the collapsed position to the upright position, the first wall may move through the first angular interval, then through the second angular interval, and then through the third angular interval.

The first wall may be translated vertically by the first cam surface, the second cam surface, and the third cam surface as it moves between the collapsed position on the base and the upright position.

A pivot axis of the first wall may be translated vertically relative to the base by the first cam surface, the second cam surface, and the third cam surface as the first wall moves between the collapsed position on the base and the upright position.

A hinge pin of the first wall may be translated vertically by the first cam surface, the second cam surface, and the third cam surface as it moves between the collapsed position on the base and the upright position.

The first follower may be one of a plurality of first followers. The second follower may be one of a plurality of second followers. The third follower may be one of a plurality of third followers. The first cam surface may be one of a plurality of first cam surfaces. The second cam surface may be one of a plurality of second cam surfaces. The third cam surface may be one of a plurality of third cam surfaces. Each of the plurality of first followers is configured to contact one of the plurality of first cam surfaces during the first angular interval. Each of the plurality of second followers is configured to contact one of the plurality of second cam surfaces during the second angular interval. Each of the plurality of third followers is configured to contact one of the third cam surfaces during the third angular interval.

The hinge may include a hinge pin pivotable and slidable vertically in a slot.

A second wall may be pivotably connected to the base opposite the first wall, wherein the second wall is translatable vertically relative to the base. The collapsible container may further include a pair of end walls pivotably connected to the base, wherein the pair of end walls are pivotable between an upright position and a collapsed position on the first wall and the second wall.

The first wall may include a U-shaped frame pivotably connected to the base and having a lower horizontal portion and a pair of vertical portions. The first wall may further include an upper portion and a lower portion pivotably connected to the pair of vertical portions.

In some aspects, the features described herein relate to a container including a base and a wall. The wall extends upward from the base. The wall may include a pair of vertical portions defining an opening therebetween, an upper portion pivotably connected to the pair of vertical portions, and a lower portion pivotably and slidably connected to the pair of vertical portions.

A link having an arm may be pivotably connected to the upper portion and pivotably connected to the lower portion.

The link may be pivotably connected to the upper portion toward an interior of the container and the link may be pivotably connected to the lower portion toward an exterior of the container.

The link may further include a stop member configured to limit relative rotation of the link and the lower portion.

The stop member may extend downward from an axis of relative rotation of the link and the lower portion.

The lower portion may be connected to the pair of vertical portions by hinges. Each hinge may include a pin pivotable and slidable within a slot extending from an outer position toward an exterior of the container and an inner position toward an interior of the container.

In each hinge, the pin may be formed on the lower portion and the slot may be formed on the vertical portion and wherein the slot angles downward as it extends toward the interior of the container.

In some aspects, the features described herein relate to a container may include a base and a wall extending upward from the base. The wall may include a pair of vertical portions defining an opening therebetween. The wall further may include an upper portion pivotably connected to the pair of vertical portions and a lower portion pivotably connected to the pair of vertical portions. A link having an arm may be pivotably connected to the upper portion and pivotably connected to the lower portion.

The link further may include a stop member configured to limit relative rotation of the link and the lower portion.

The stop member may extend downward from an axis of relative rotation of the link and the lower portion.

The link may be pivotably connected to the upper portion toward an interior of the container and the link may be pivotably connected to the lower portion toward an exterior of the container.

The arm of the link may be one of a pair of arms projecting from a lower member.

The lower member may be rotatably coupled to the lower portion.

The link may include at least one stop member projecting from the lower member and configured to contact the lower portion and to initiate rotation of the lower portion upon rotation of the upper portion outward from the pair of vertical portions.

The link may be pivotably connected to the upper portion toward an interior of the container and the link may be pivotably connected to the lower portion toward an exterior of the container.

DESCRIPTION OF PREFERRED EMBODIMENT

Figure 1:
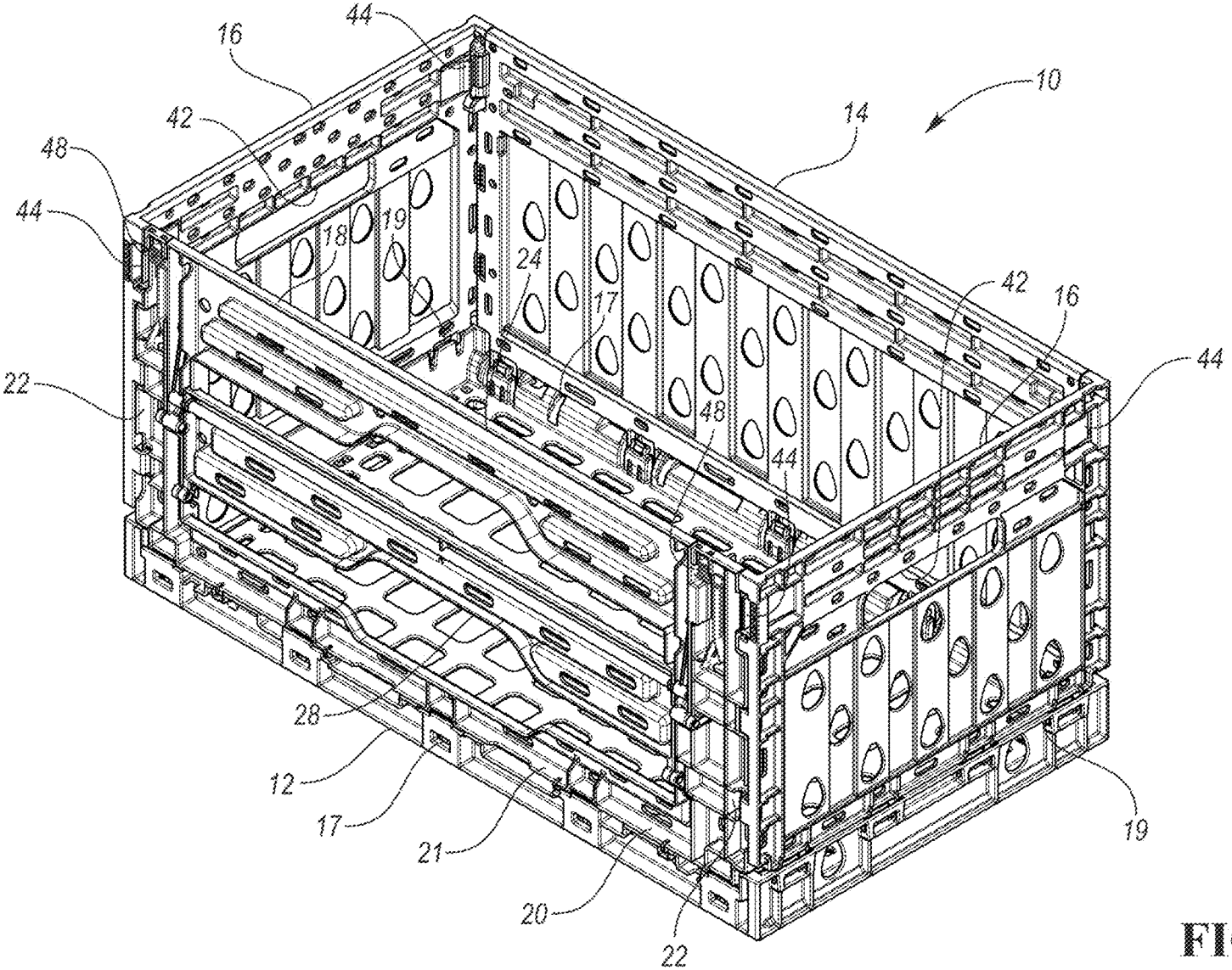
FIG. 1 is a perspective view of a collapsible container according to one example embodiment.

A collapsible container 10 according to one embodiment is shown in FIG. 1. In FIG. 1, the container 10 is in an upright, assembled position. The container 10 includes a base 12. A rear wall 14, opposed end walls 16 and a front wall 18 are pivotably connected at a periphery of the base 12.

The base 12 includes upstanding flanges 17 projecting upward from rear and front edges of the base 12 and formed integrally with the rest of the base 12. The base includes end flanges 19 projecting upward from end edges of the base 12 and formed integrally with the rest of the base 12. The front wall 18 and rear wall 14 are pivotably connected to the flanges 17 at the front and rear edges of the base 12, respectively. The end walls 16 are pivotably connected to the end flanges 19 at the end edges of the base 12. The end flanges 19 are taller than the front and rear flanges 17.

The front wall 18 includes a frame 20 pivotably connected to the flange 17 at the front of the base 12. The frame 20 includes a lower horizontal portion 21 and a pair of upright vertical portions 22, together forming a U shape opening upwardly, with the large opening being the vast majority (over 90%) of the area of the front wall 18. The front wall 18 further includes an upper (or "first") portion 24 and a lower (or "second") portion 28 within the frame 20. In FIG. 1, the front wall 18 is in the closed position with the upper portion 24 and lower portion 28 substantially closing the large opening in the frame 20.

In FIG. 1, the walls 14, 16, 18 are in their upright, use position. The front wall 18 is in its deployed, closed position, with the upper portion 24 and lower portion 28 extending across an upper portion and a lower portion respectively, of the large opening defined by the frame 20. In the deployed, closed position, the front wall 18 keeps objects, such as egg cartons, in the container 10.

The end walls 16 are pivotably connected to the end flanges 19 of the base 12. Each end wall includes a handle opening 42 near an upper edge thereof. Each end wall 16 includes a pair of latches 44 molded therein for selectively securing the end wall 16 to the rear wall 14 and to the front wall 18 (more specifically to the frame 20).

Figure 2:
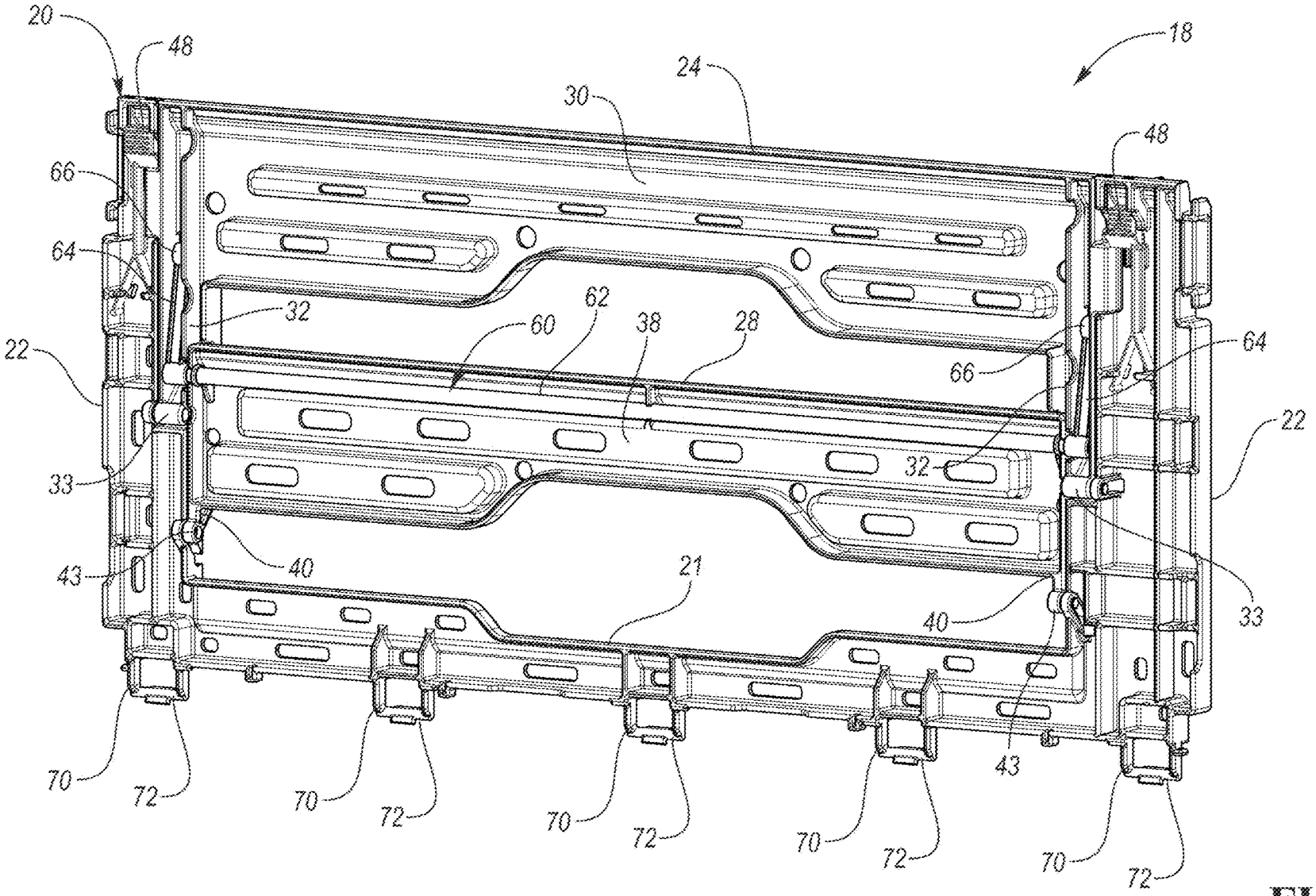
FIG. 2 shows the front wall of the container of FIG. 1.
Figure 3:
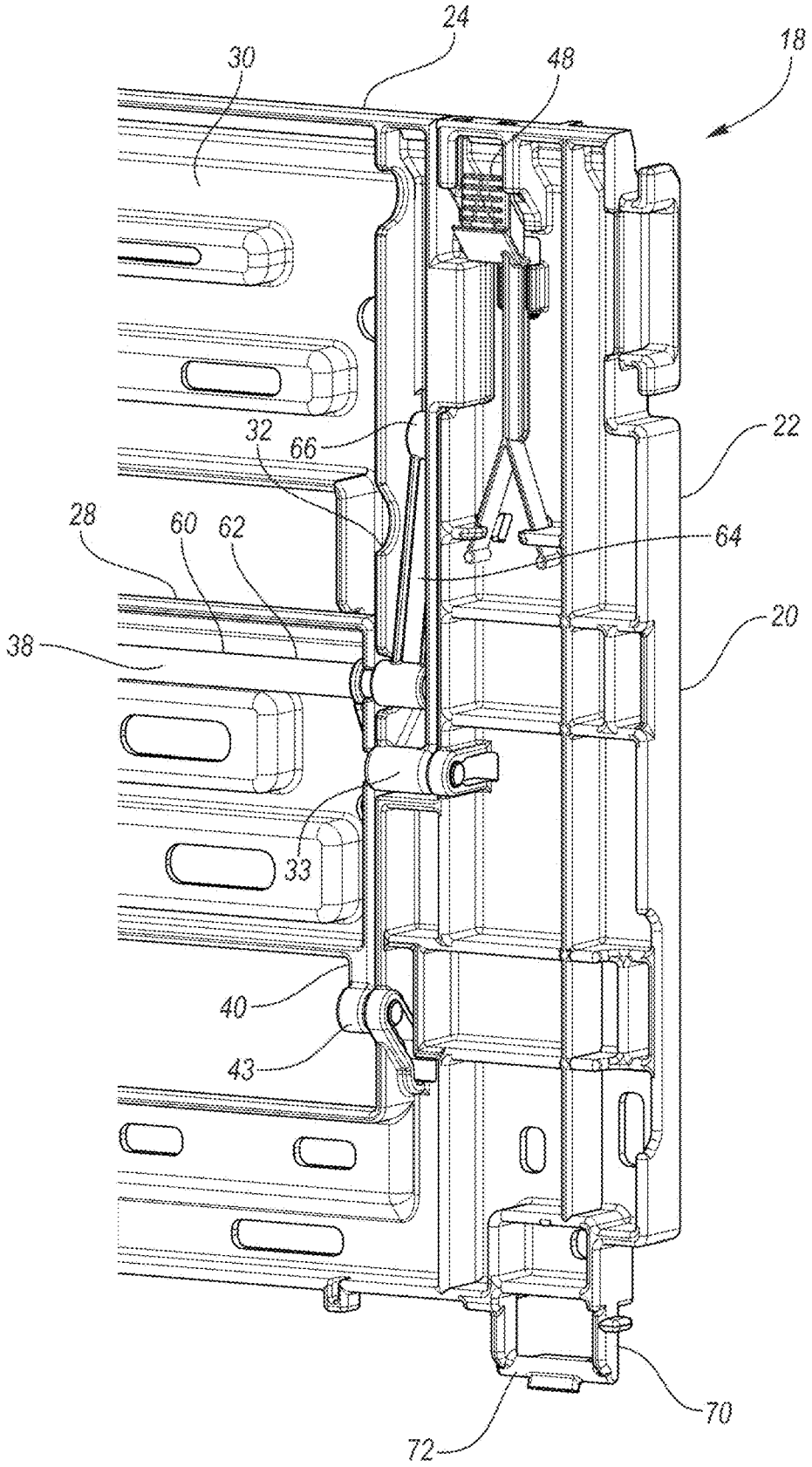
FIG. 3 is an enlarged view of a one end of the front wall of FIG. 2.

FIG. 2 shows the front wall 18. FIG. 3 is an enlarged view of a one end of the front wall 18. The other end would be mirror image. Referring to FIGS. 2 and 3, the upper portion 24 includes a horizontal wall portion 30 and a pair of arms 32 extending downward from ends of the horizontal wall portion 30 in a direction generally in the plane of the horizontal wall portion 30 to form generally a U-shape (opening downward in FIG. 2). In FIGS. 2 and 3, the upper portion 24 is selectively secured to the frame 20 in a retracted, closed position by latches 48. The arms 32 of the upper portion 24 are pivotably connected to the vertical portions 22 of the frame 20 via hinges 33.

The lower portion 28 includes a horizontal wall portion 38 and a pair of arms 40 extending downward from ends of the horizontal wall portion 38 in a direction generally in the plane of the horizontal wall portion 38 to form generally a U-shape (opening downward in FIG. 1). The arms 40 of the lower portion 28 are pivotably connected to the vertical portions 22 of the frame 20 via hinge pins 43, which will be explained in more detail below. The lower portion 28 is partially received between the arms 32 of the upper portion 24. In this example, the horizontal wall portion 38 and upper portions of the arms 40 are received between lower portions of the arms 32 of the upper portion 24.

A link 60 connects the lower portion 28 to the upper portion 24. The link 60 includes a lower member 62 extending the full width of the lower portion 28. The lower member 62 is higher (relative to the base 12, FIG. 1) than the hinge 33 of the upper portion 24. Arms 64 project upward (in FIG. 2) from opposite ends of the lower member 62 to coupling members 66. The lower member 62 is pivotably secured to the lower portion 28. The coupling members 66 are pivotably secured to the upper portion 24 at points between the hinge 33 and upper edge of the upper portion 24.

A plurality of hinge members 70 project downward from the lower horizontal portion 21 of the frame 20 and are formed integrally with the frame 20. Each hinge member 70 includes a hinge pin 72.

Figure 4:
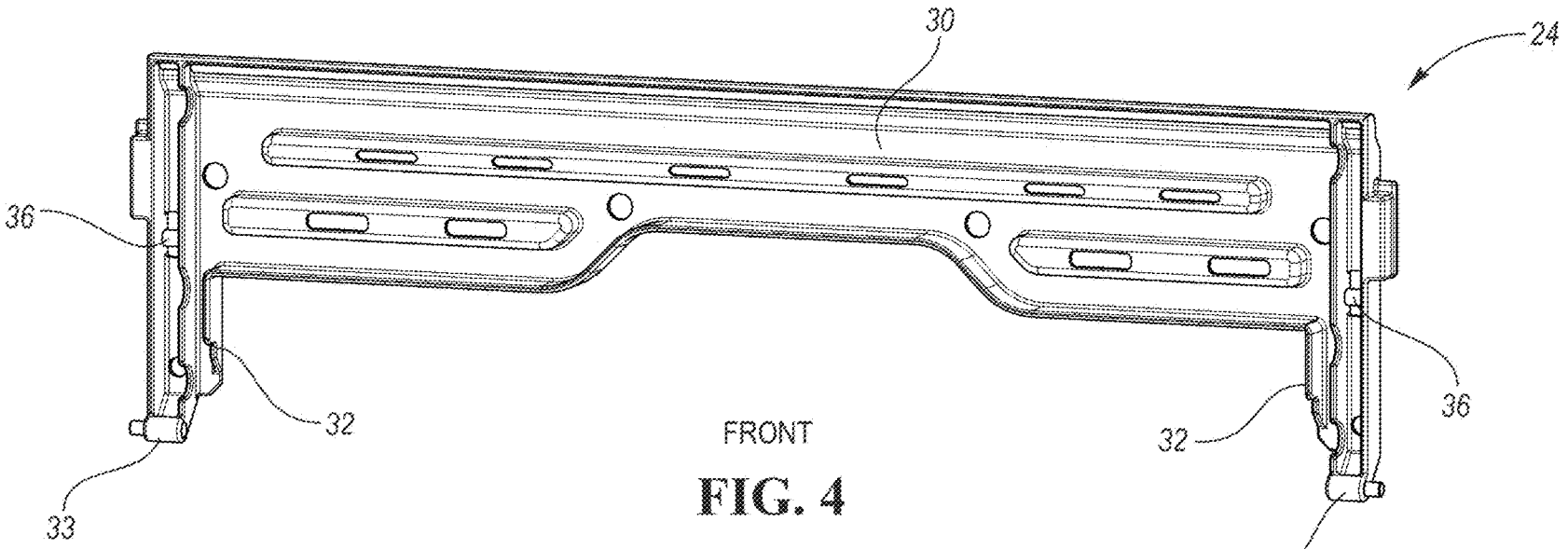
FIGS. 4 and 5 are front and rear perspective views of the upper portion of the front wall of FIG. 3.
Figure 5:
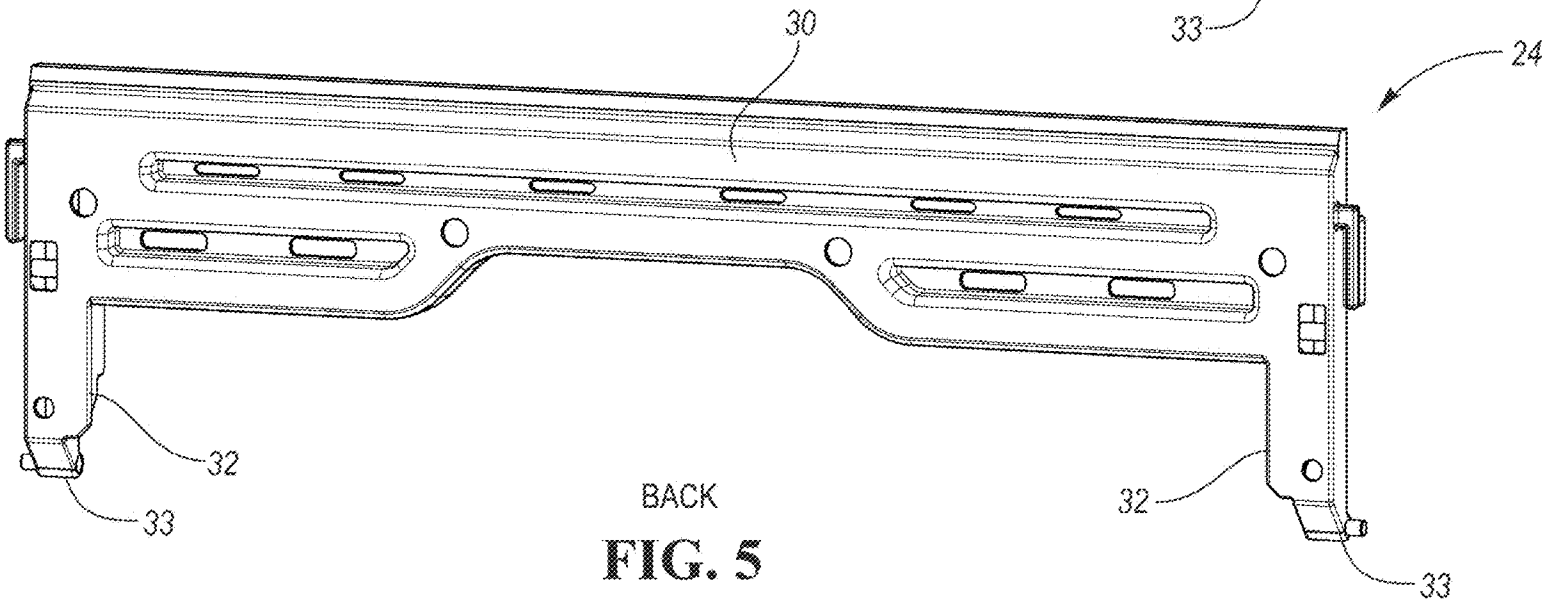

FIGS. 4 and 5 are front and rear perspective views of the upper portion 24. Mid hinge pins 36 are positioned between the hinge pins 33 and an upper edge of the upper portion 24. The hinge pins 33 are positioned toward the front (exterior) and the mid hinge pins 36 are positioned toward the back (interior) of the upper portion 24. The mid hinge pins 36 are configured to be pivotably connected to the coupling members 66 of the link 60 (FIG. 2).

Figure 6:
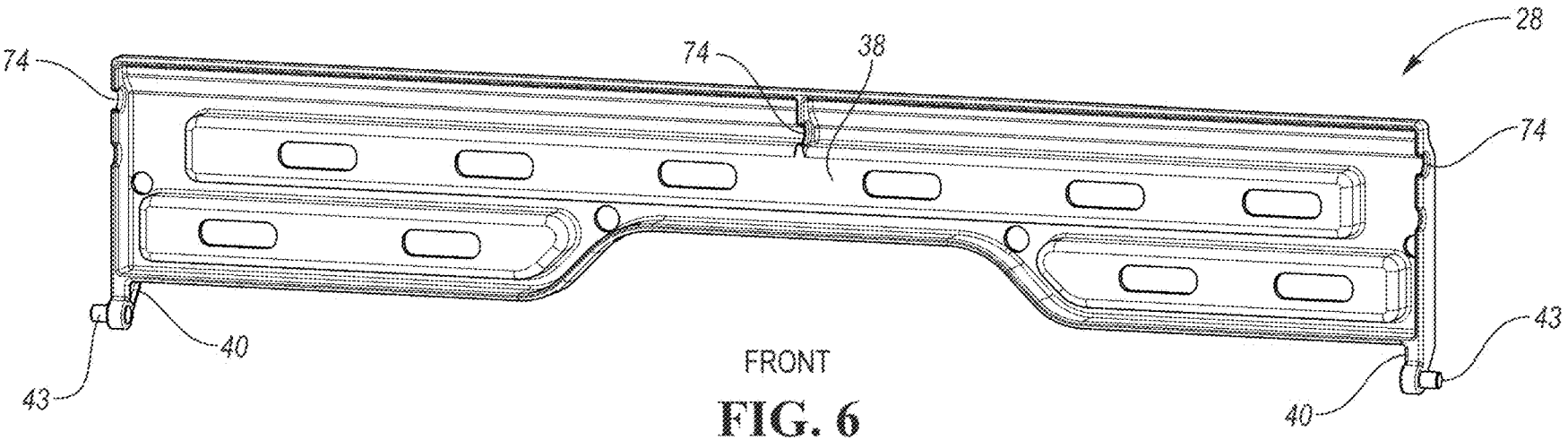
FIGS. 6 and 7 are front and rear perspective views of the lower portion of the front wall of FIG. 3.
Figure 7:
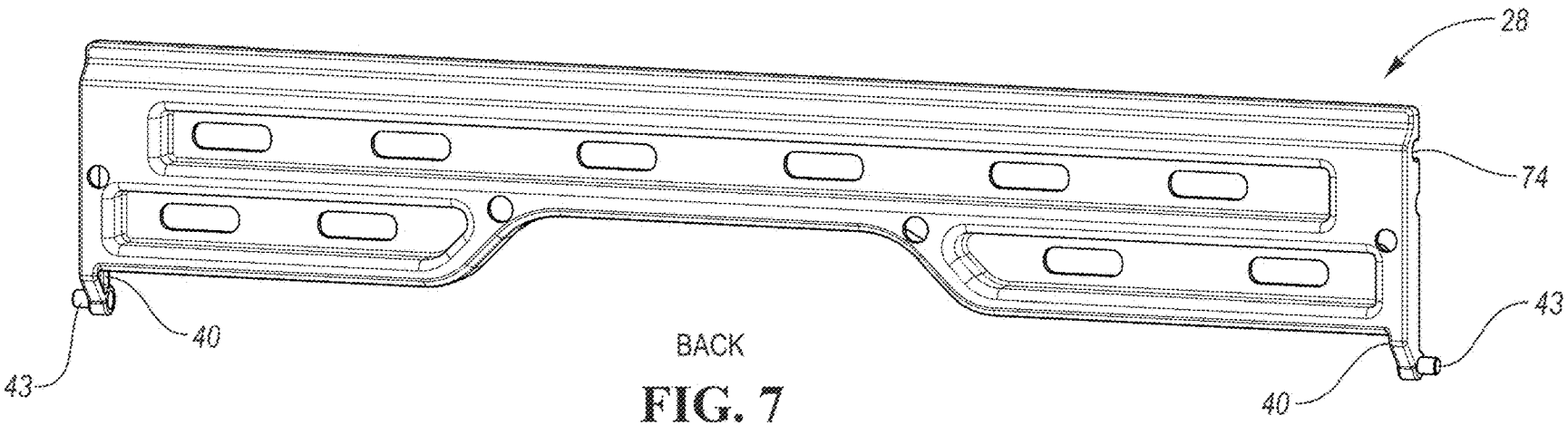

FIGS. 6 and 7 are front and rear perspective views of the lower portion 28. The lower portion 28 includes the pair of arms 40 extending from ends of the horizontal wall portion 38 generally in the plane of the horizontal wall portion 38 to form substantially a U-shape opening downward. Hinge pins 43 project outward from lower ends of the arms 40 of the lower portion 28. The lower portion 28 includes a plurality of notches 74 (three in this example) that open forward (toward the exterior) and are configured to receive the lower member 62 of the link 60 via a snap-fit connection, such that the lower member 62 would be rotatably connected within the notches 74. The notches 74 are positioned forwardly (toward the exterior) of the lower portion 28 to position that pivot axis of the link 60 relative to the lower portion 28 forward (i.e. toward the exterior).

Figure 8:
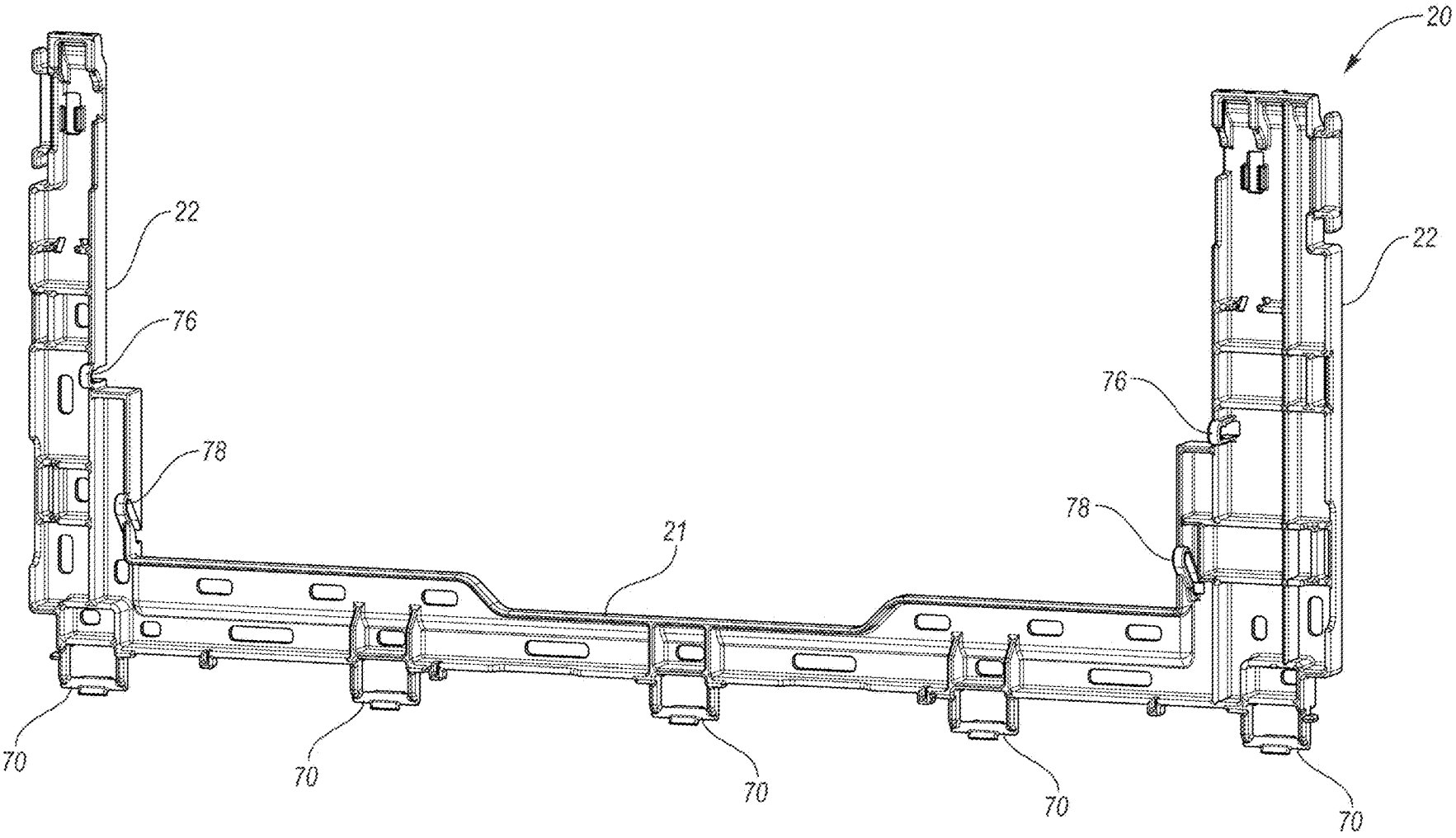
FIGS. 8 and 9 are front and rear perspective views of the frame of the front wall of FIG. 3.
Figure 9:
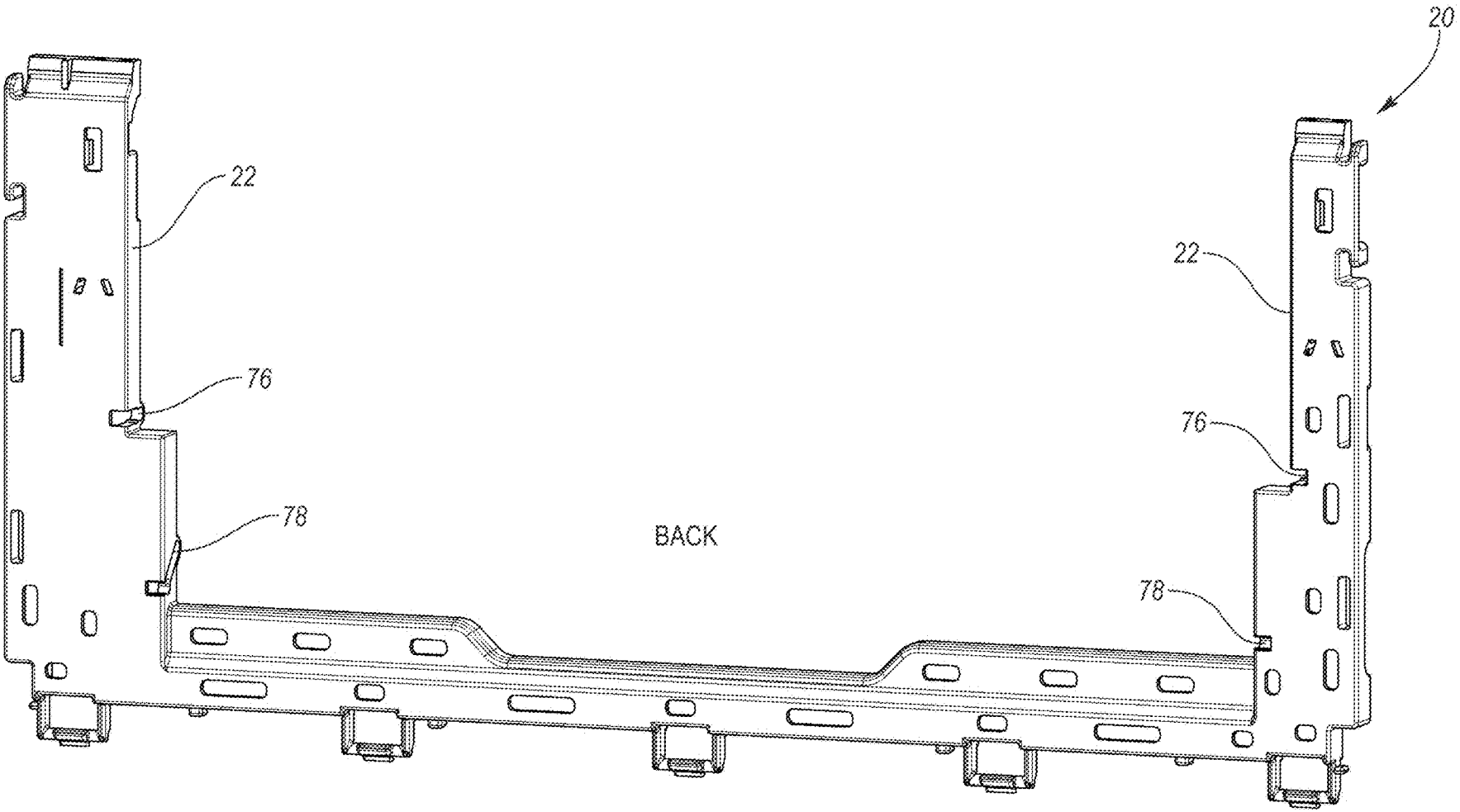

FIGS. 8 and 9 are front and rear perspective views of the frame 20. Each of the vertical portions 22 includes an upper hinge receiver 76 for receiving the hinge pin 33 of the upper portion 24 (FIG. 4). Each of the vertical portions 22 includes a lower hinge receiver 78 for receiving the hinge pin 43 of the lower portion 28 (FIG. 6). The lower hinge receivers 78 are lower than the upper hinge receivers 76 and are spaced inward (i.e. toward one another) of the upper hinge receivers 76.

Figure 9A:
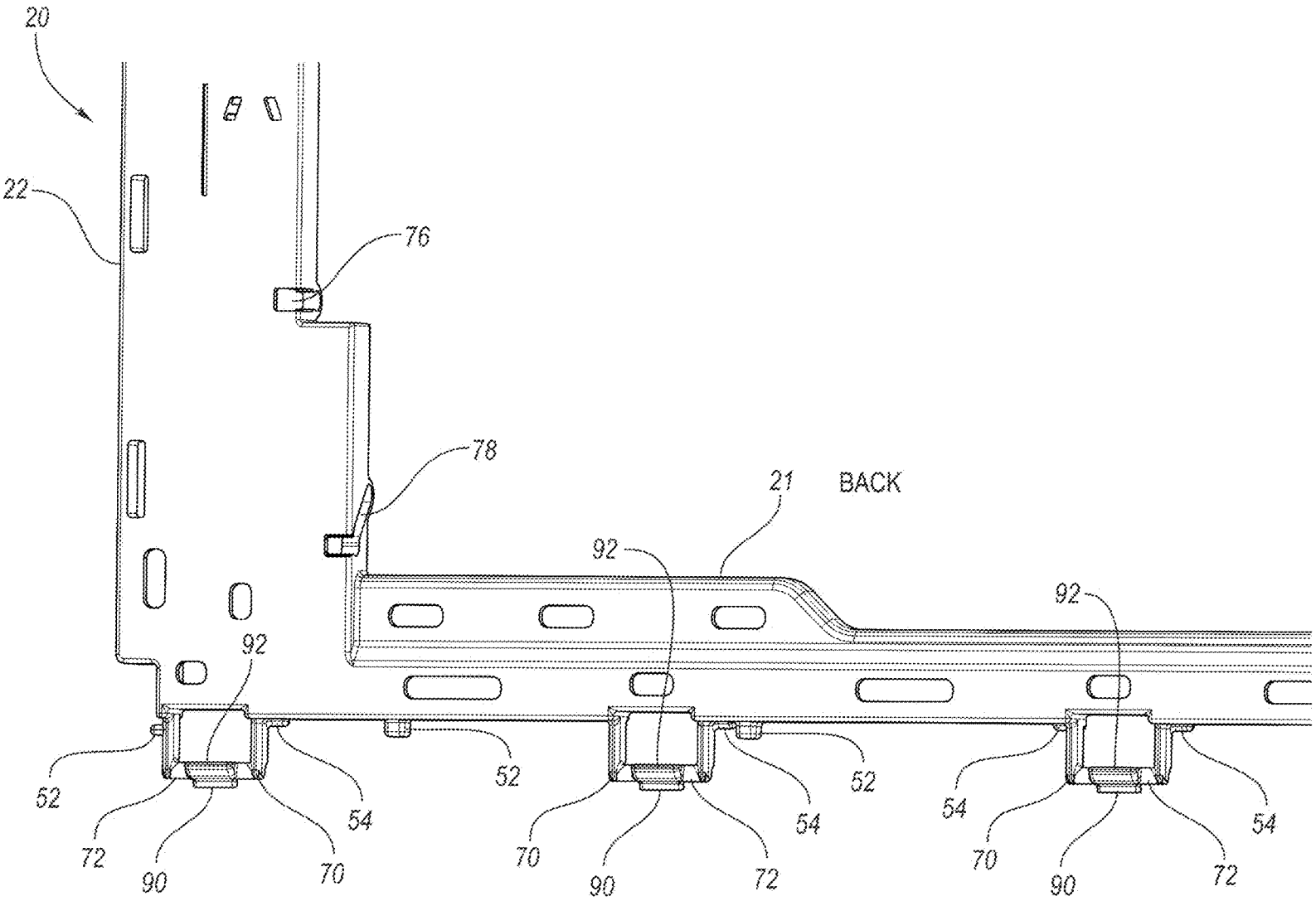
FIG. 9A is an enlarged view of one of the vertical portions of the frame of FIG. 8.

FIG. 9A is an enlarged inner view of one of the vertical portions 22 of the frame 20. The lower hinge receiver 78 is an angled slot, angled downwardly from front to rear (i.e. from exterior to interior) of the frame 20. The other lower hinge receiver 78 is the same.

The plurality of hinge members 70 project downward from the lower horizontal portion 21 of the frame 20 and are molded integrally with the frame 20. Again, each hinge member 70 includes the hinge pin 72. The hinge pin 72 of each hinge member 70 includes a tongue 90 extending downward and angling outward slightly (i.e. toward the exterior while the frame 20 is in the vertical position). Each tongue 90 is a first follower, as will be explained below. The hinge member 70 further includes an inwardly projecting lobe 92, which is horizontal when the frame 20 is in the vertical position.

The lower surface of the frame 20 further includes a plurality of second followers 52 and a plurality of third followers 54. The second followers 52 project downward further than do the third followers 54.

Figure 10:
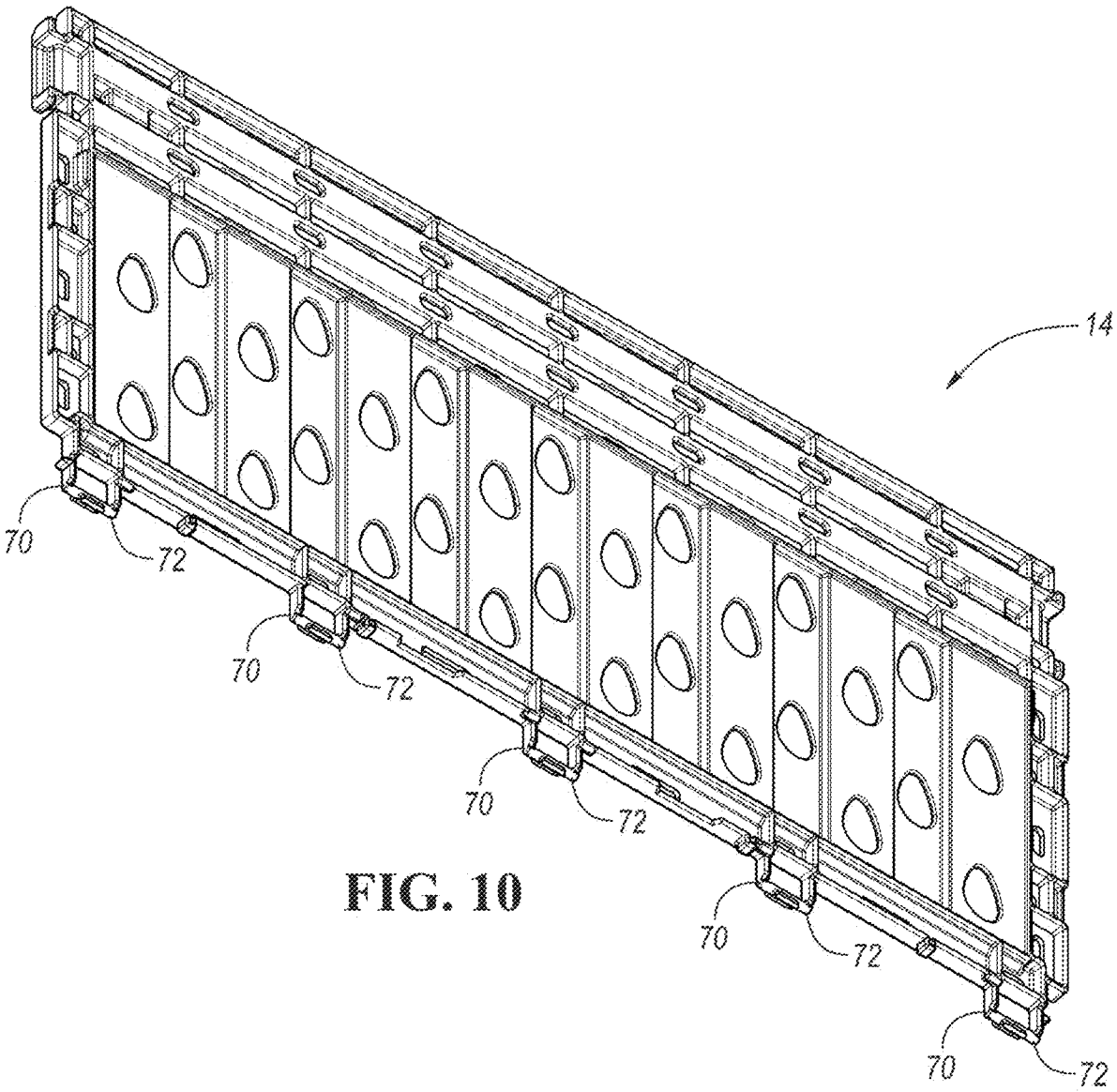
FIG. 10 is a bottom perspective view of the rear wall.
Figure 10A:
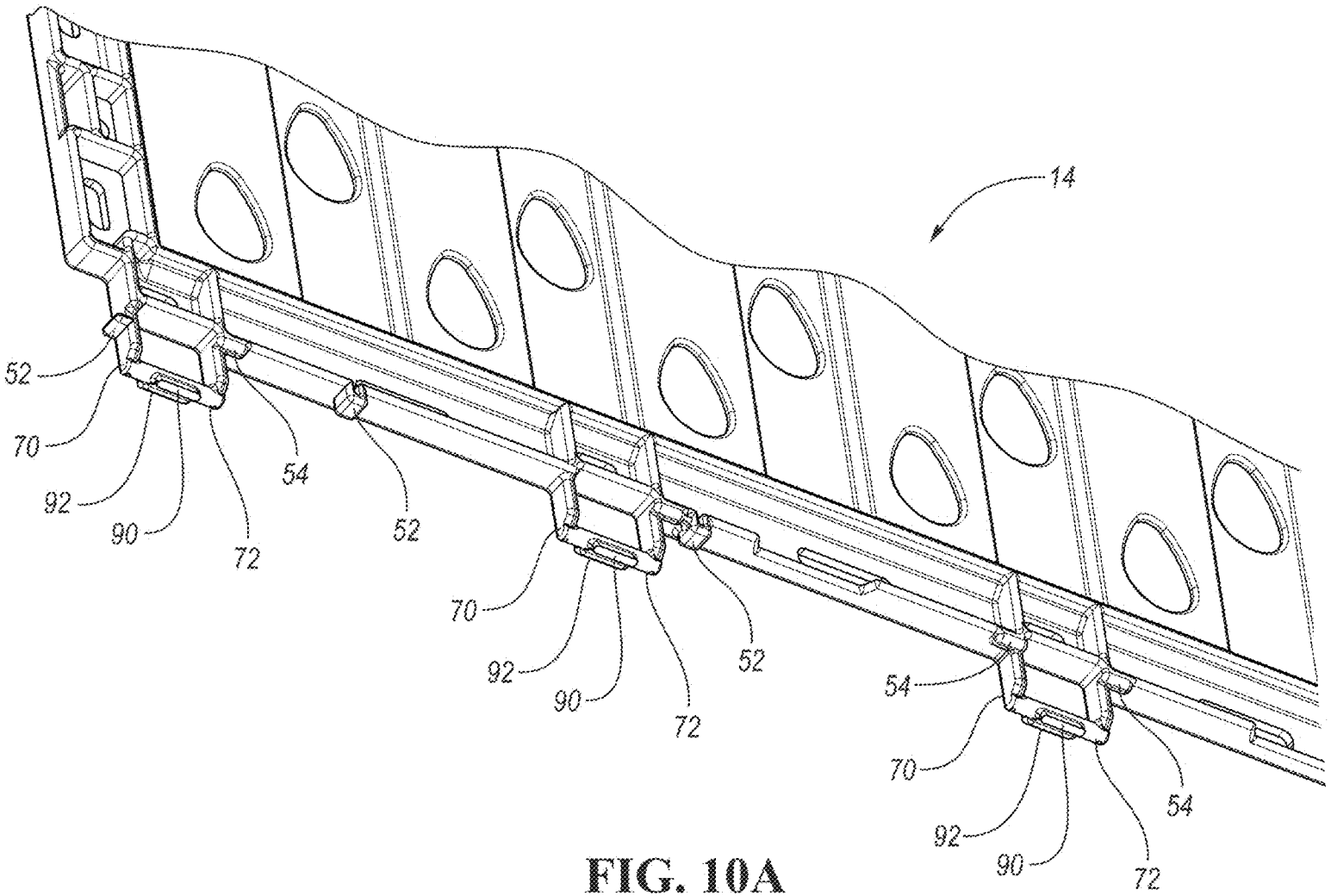
FIG. 10A is an enlarged view of a portion of the rear wall of FIG. 10.

FIG. 10 is a bottom perspective view of the rear wall 14. FIG. 10A is an enlarged view of a portion of the rear wall 14 of FIG. 10. In this embodiment, the bottom of the rear wall 14 is the same as the bottom of the frame 20 (FIGS. 9 and 9A) so both the front wall 18 and the rear wall 14 are vertically translatable and they can be folded onto the base 12 in either sequence. The plurality of hinge members 70 project downward from the bottom of the wall 14. Again, each hinge member 70 includes the hinge pin 72. The hinge pin 72 of each hinge member 70 includes a tongue 90 extending downward and angling outward slightly (i.e. toward the exterior while the rear wall 14 is in the vertical position). Each tongue 90 is a first follower, as will be explained below. The hinge member 70 further includes an inwardly projecting lobe 92, which is substantially horizontal when the rear wall 14 is in the vertical position.

The lower surface of the rear wall 14 further includes a plurality of second followers 52 and a plurality of third followers 54. The second followers 52 project downward further than do the third followers 54.

Figure 11:
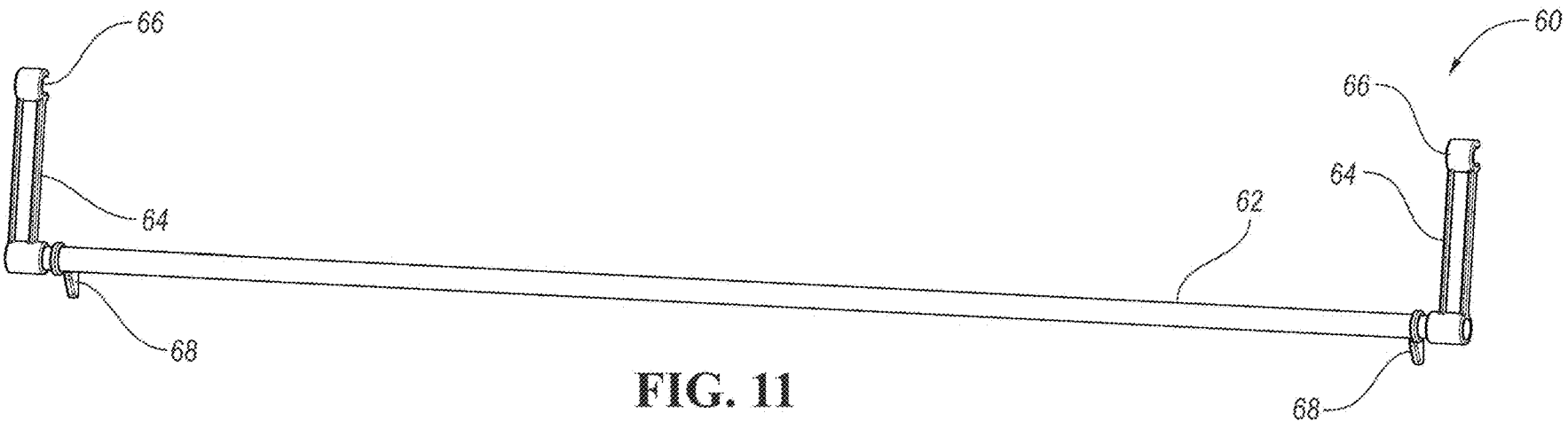
FIGS. 11 and 12 show the link of FIG. 2.
Figure 12:
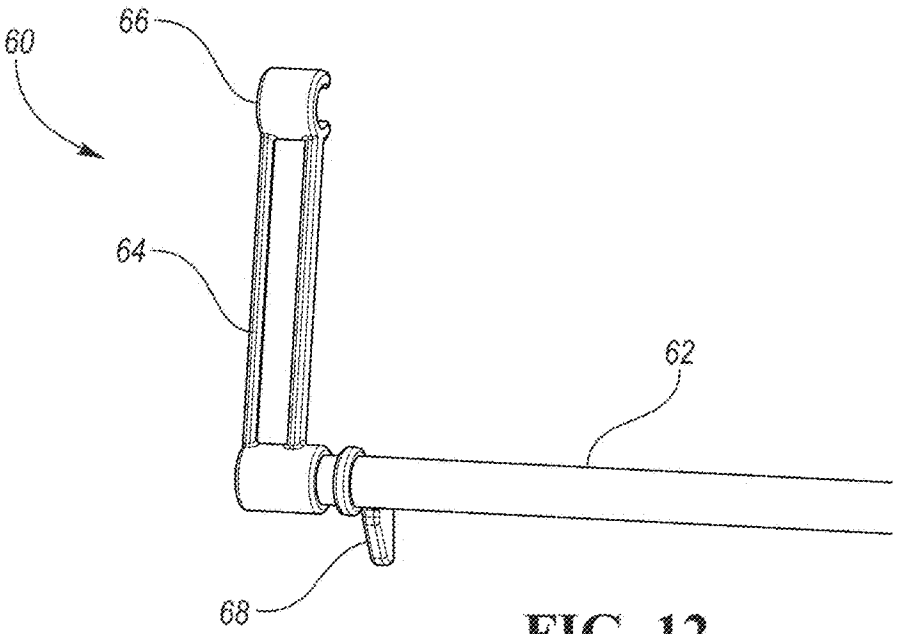

FIGS. 11 and 12 show the link 60. Again, the link 60 includes the lower member 62. Arms 64 project upward (in FIGS. 11 and 12) from opposite ends of the lower member 62 to coupling members 66. The coupling members 66 may be C-shaped coupling members, capable of a snap-fit rotatable connection. As is further shown in FIGS. 11 and 12, stop members 68 project downward from the lower member 62.

Figure 13:
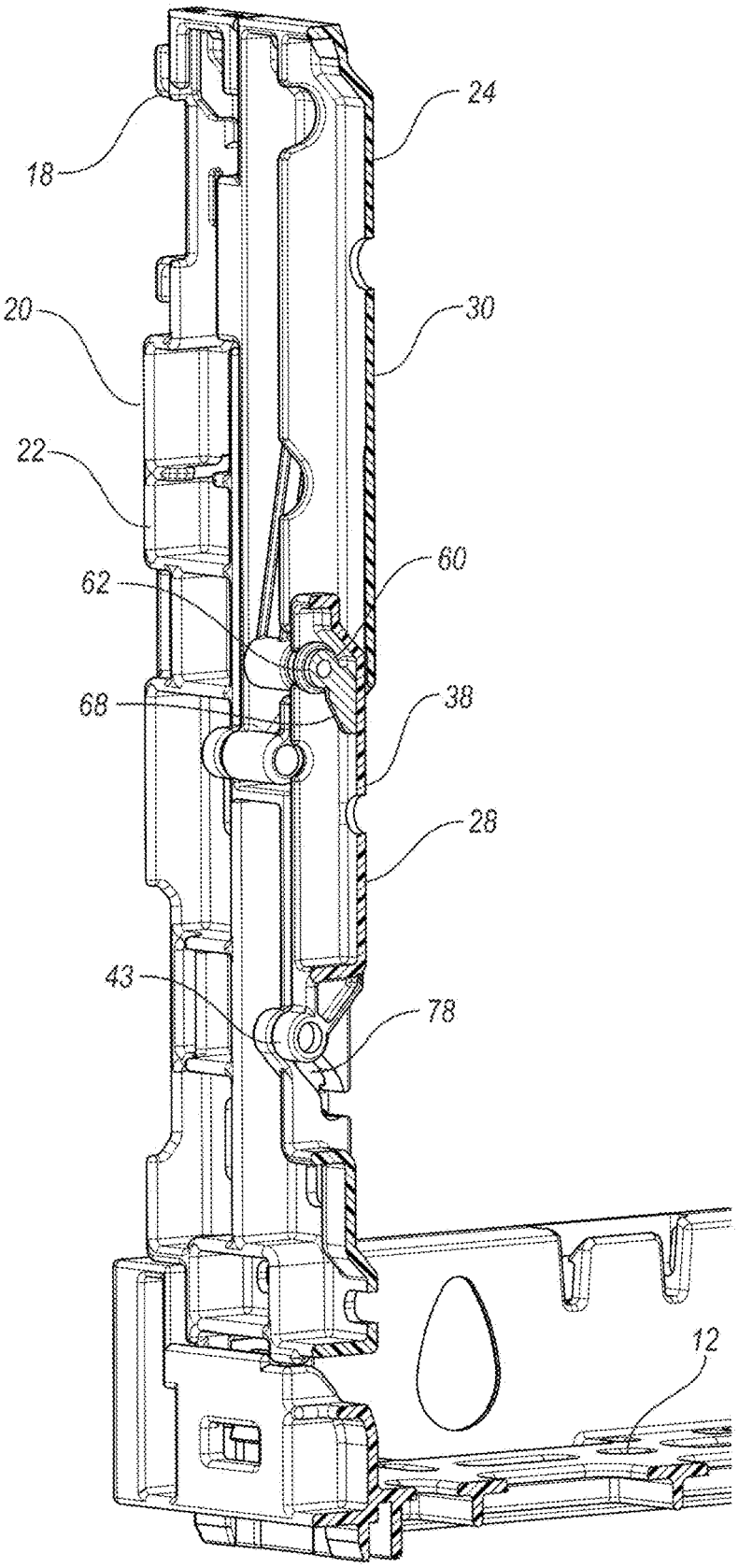
FIG. 13 shows the front wall and base of FIG. 1 partially broken away.

FIG. 13 shows the front wall 18 partially broken away. With the front wall 18 in the upright, closed position as shown, the stop member 68 of the link 60 abuts the wall portion 38 of the lower portion 28. The hinge pin 43 is positioned at a forward (i.e. toward the exterior), upper end of the lower hinge receiver 78 (again, the opposite side of the front wall 18 would be the same).

Figure 14:
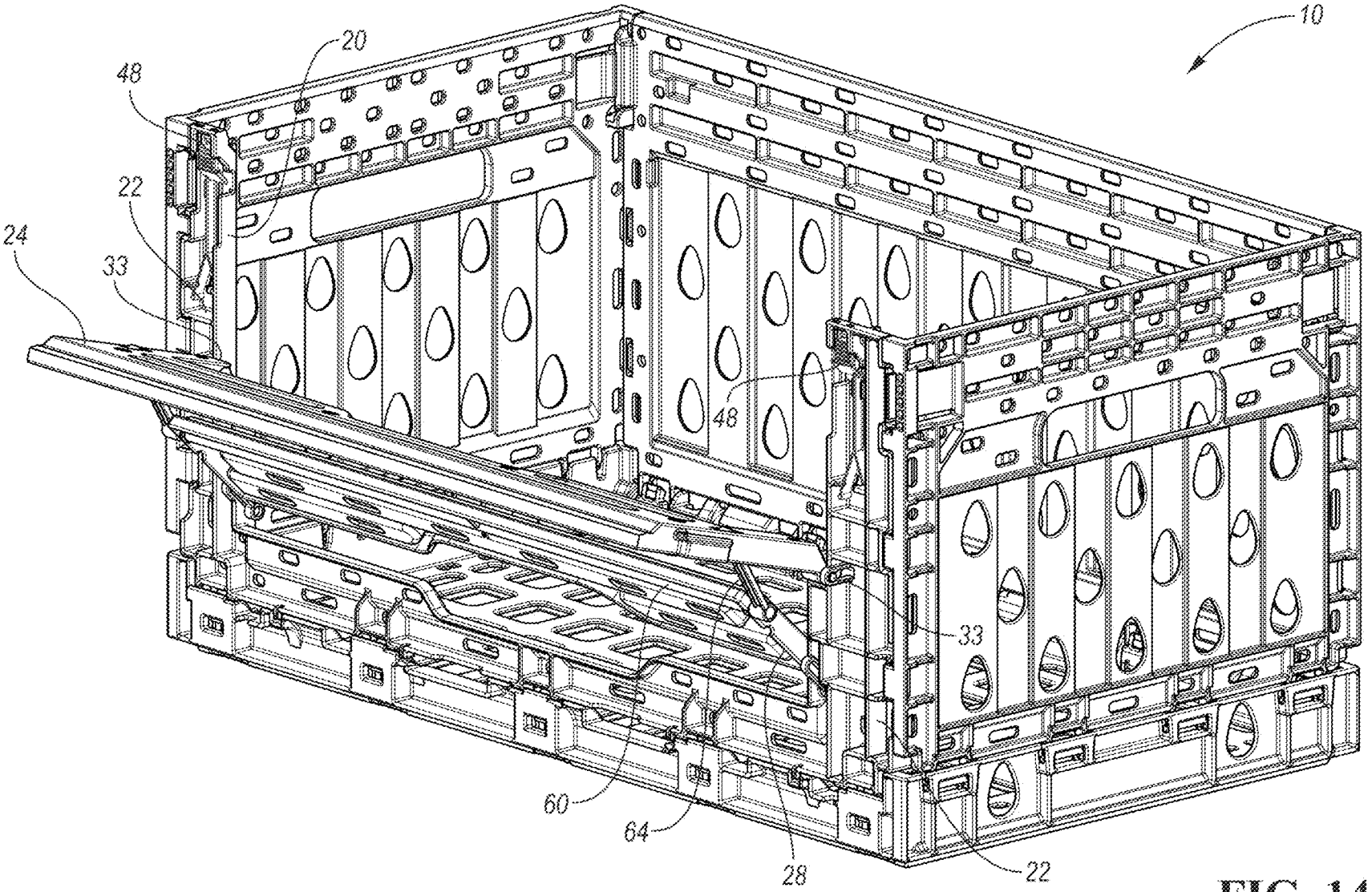
FIG. 14 shows an initial step in retracting the front wall of the container of FIG. 1.

As shown in FIG. 14, after releasing the latches 48, the front wall can be moved toward a retracted position by pivoting the upper portion 24 outward on its hinges 33. This also causes the lower portion 28 to pivot outward as explained below.

Figure 15:
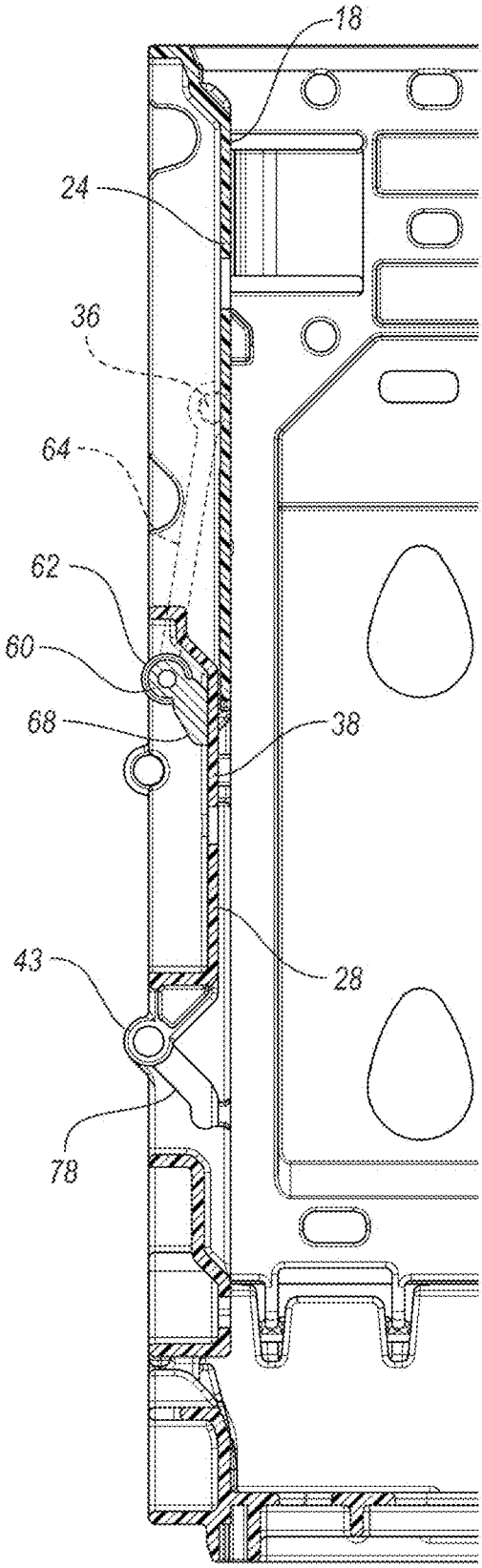
FIG. 15 is a section view through the front wall of the container of FIG. 1 in the upright, closed position.

FIG. 15 is a section view through the front wall 18 in the upright, closed position, similar to FIG. 13. As can be seen in FIG. 15, the mid hinge pins 36 are positioned toward the interior of the container 10 and the lower member 62 of the link 60 is positioned toward the exterior of the container 10, putting the link 60 at about a ten-degree angle. The lower member 62 of the link 60 is the axis about which the lower portion 28 pivots relative to the link 60.

Figure 16:
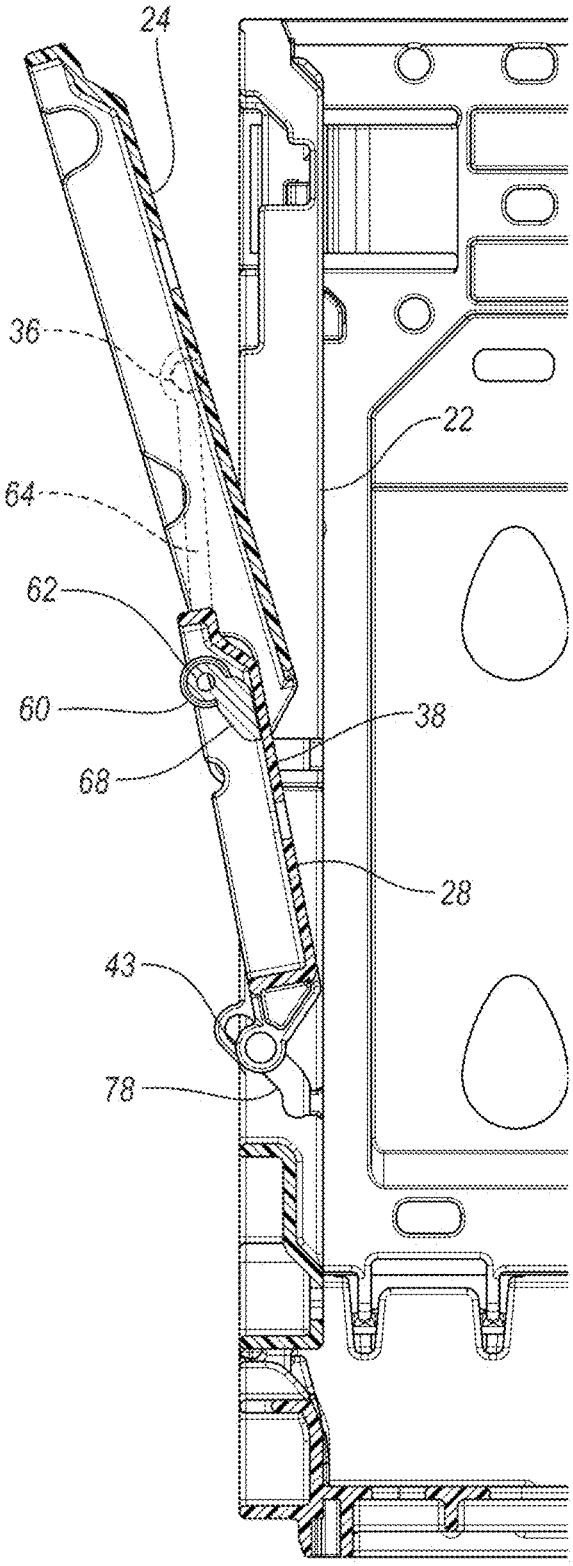
FIG. 16 shows the front wall of FIG. 15 in the initial step of being retracted.

In FIG. 16, the upper portion 24 has been pivoted outward slightly on its hinges 33 (not visible). This forces the upper ends of the arms 64 of the link 60 outward as well. The stop members 68 of the link 60 bear against the wall portion 38 of the lower portion 28, which causes the lower member 62 of the link 60 to move the upper end of the lower portion 28 outward, pivoting the lower portion 28 on its hinge pins 43 within the lower hinge receivers 78. In this way, by causing the lower portion 28 to pivot outward soon after the upper portion 24 starts to pivot outward, the front wall 18 movement is smoother and less likely to bind. Generally, the hinge pins 43 start to slide downward and inward (rearward) away from the upper forward ends of the lower hinge receivers 78. This helps keep the force vector outside the lower rotation point (the hinge pins 43), which again provides smoother movement and avoids binding.

Figure 17:
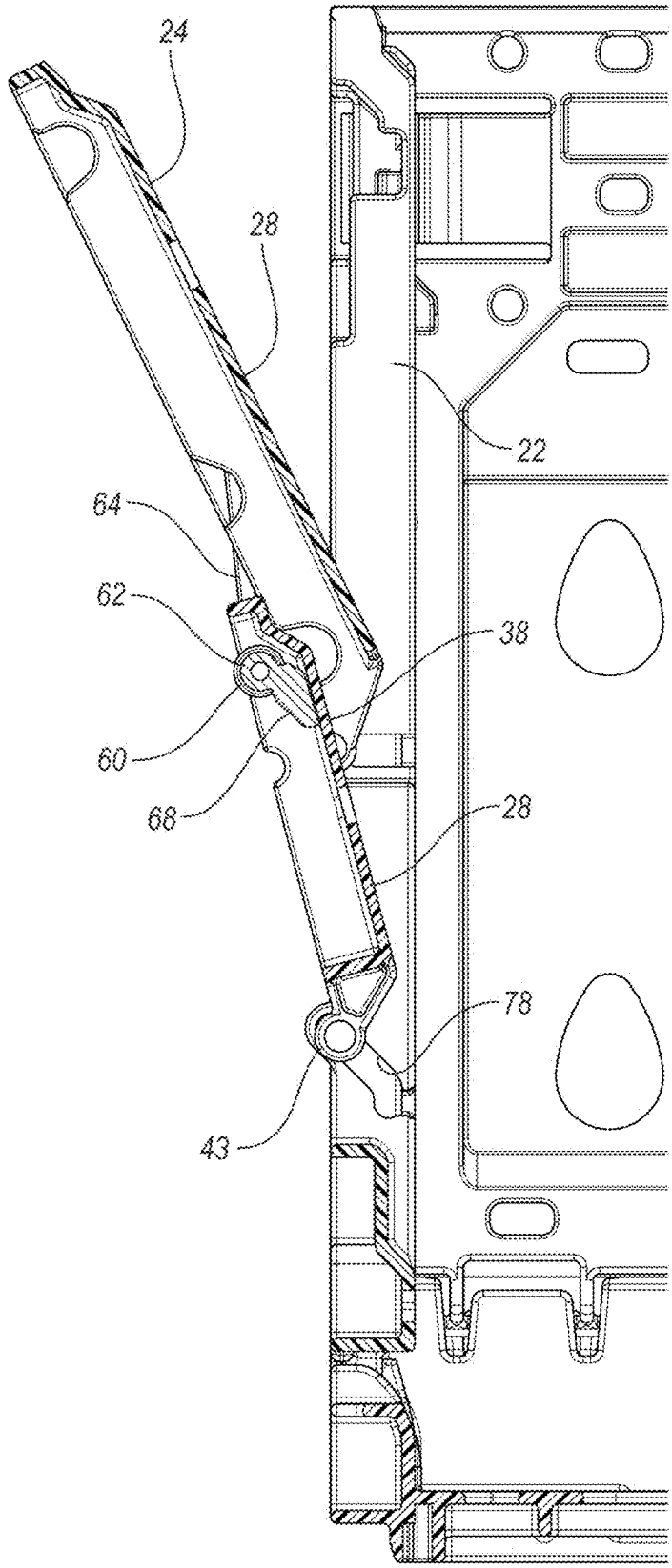
FIGS. 17 to 23 show the front wall of FIG. 15 in subsequent steps of being retracted.
Figure 18:
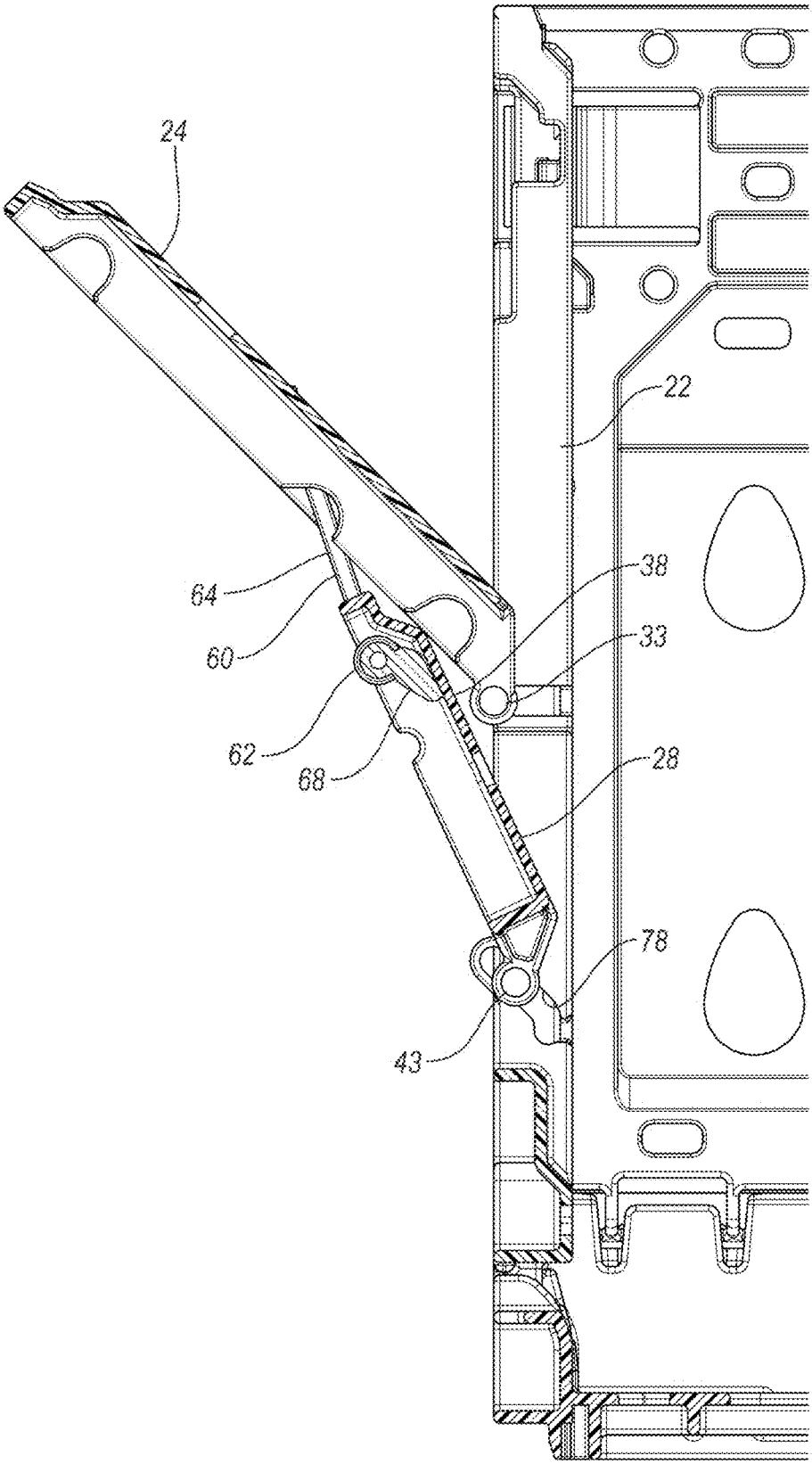

In FIGS. 17 and 18, as the upper portion 24 is pivoted further outward, the upper portion 24 pushes outward and downward on the lower portion 28 via the arms 64 of the link 60, which is now outward of the hinge pins 43. Because the forces are outward of the hinge pins 43, the lower portion 28 is ensured to pivot smoothly without binding.

Figure 19:
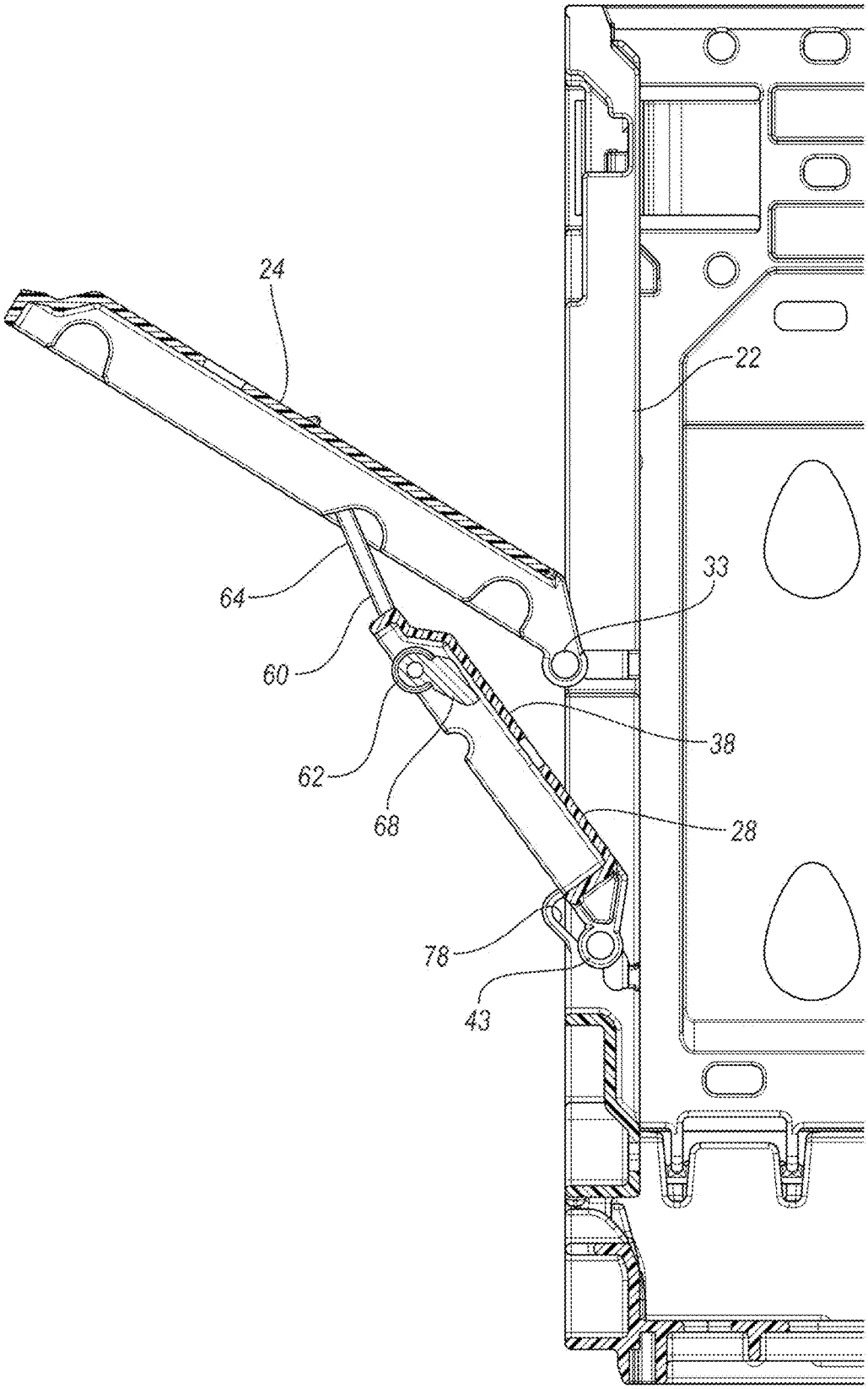
Figure 20:
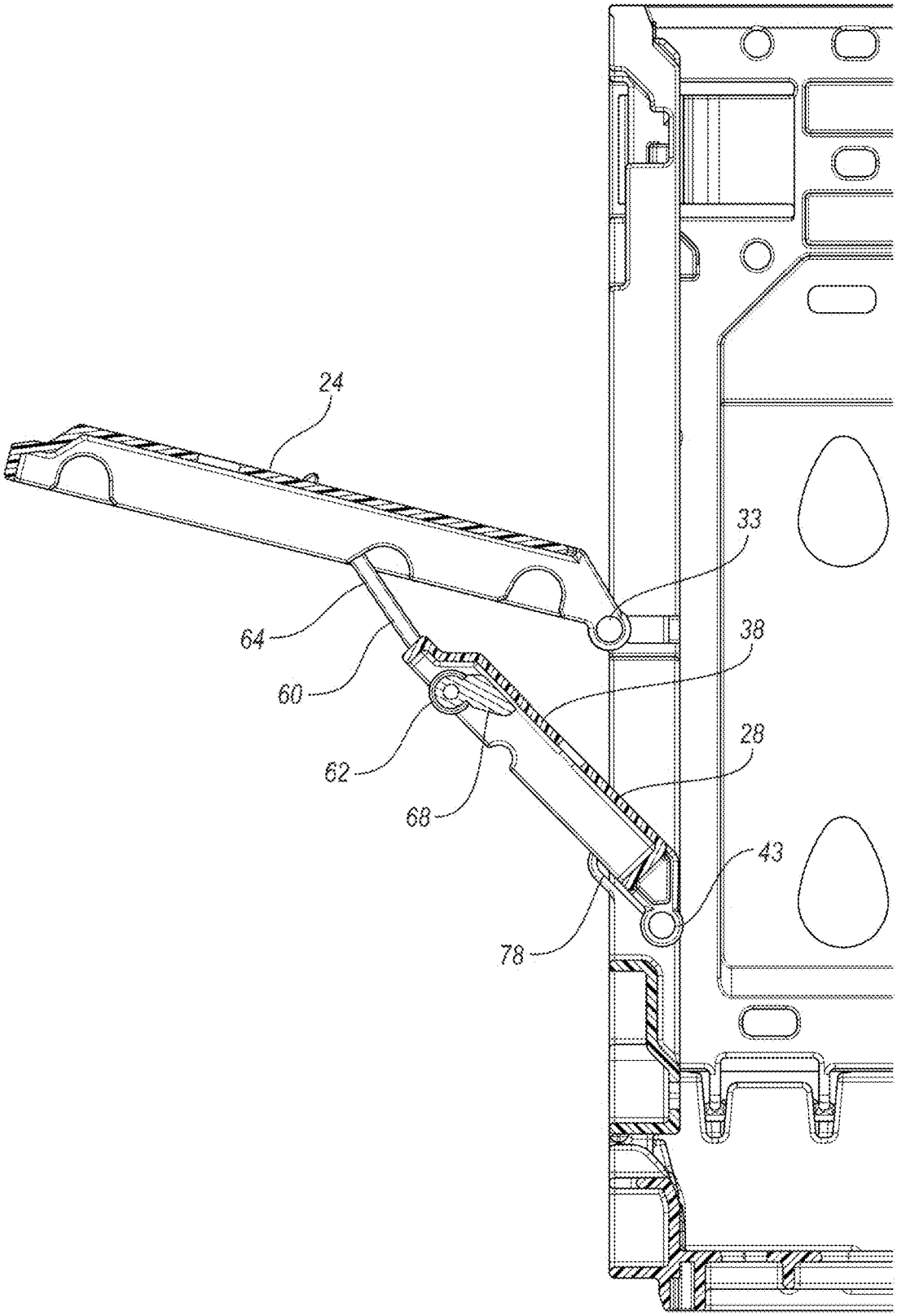

FIGS. 19 and 20 show the upper portion 24 and lower portion 28 pivoted further outwardly. The hinge pins 43 continue to move inward and downward in the lower hinge receivers 78.

Figure 21:
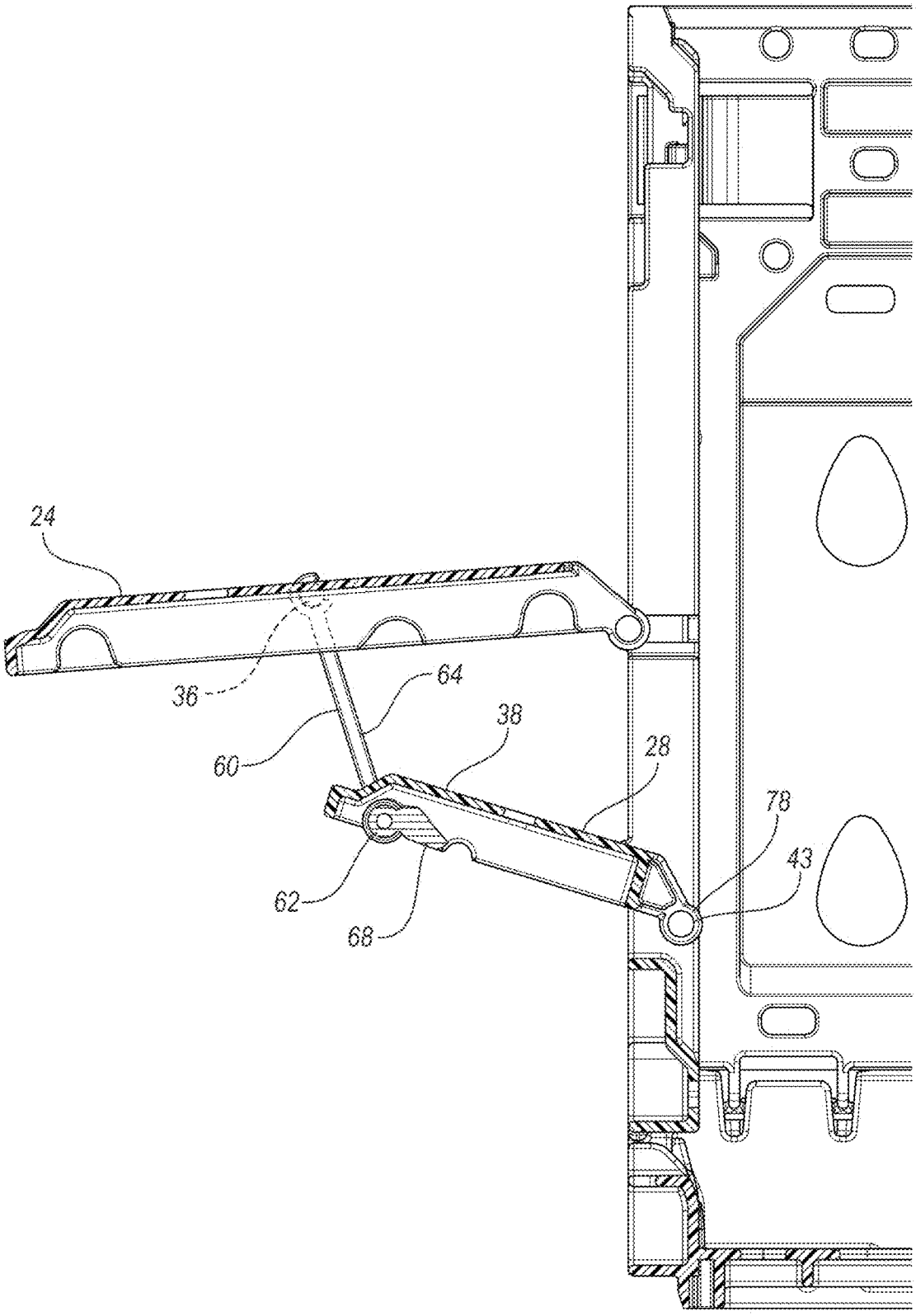
Figure 22:
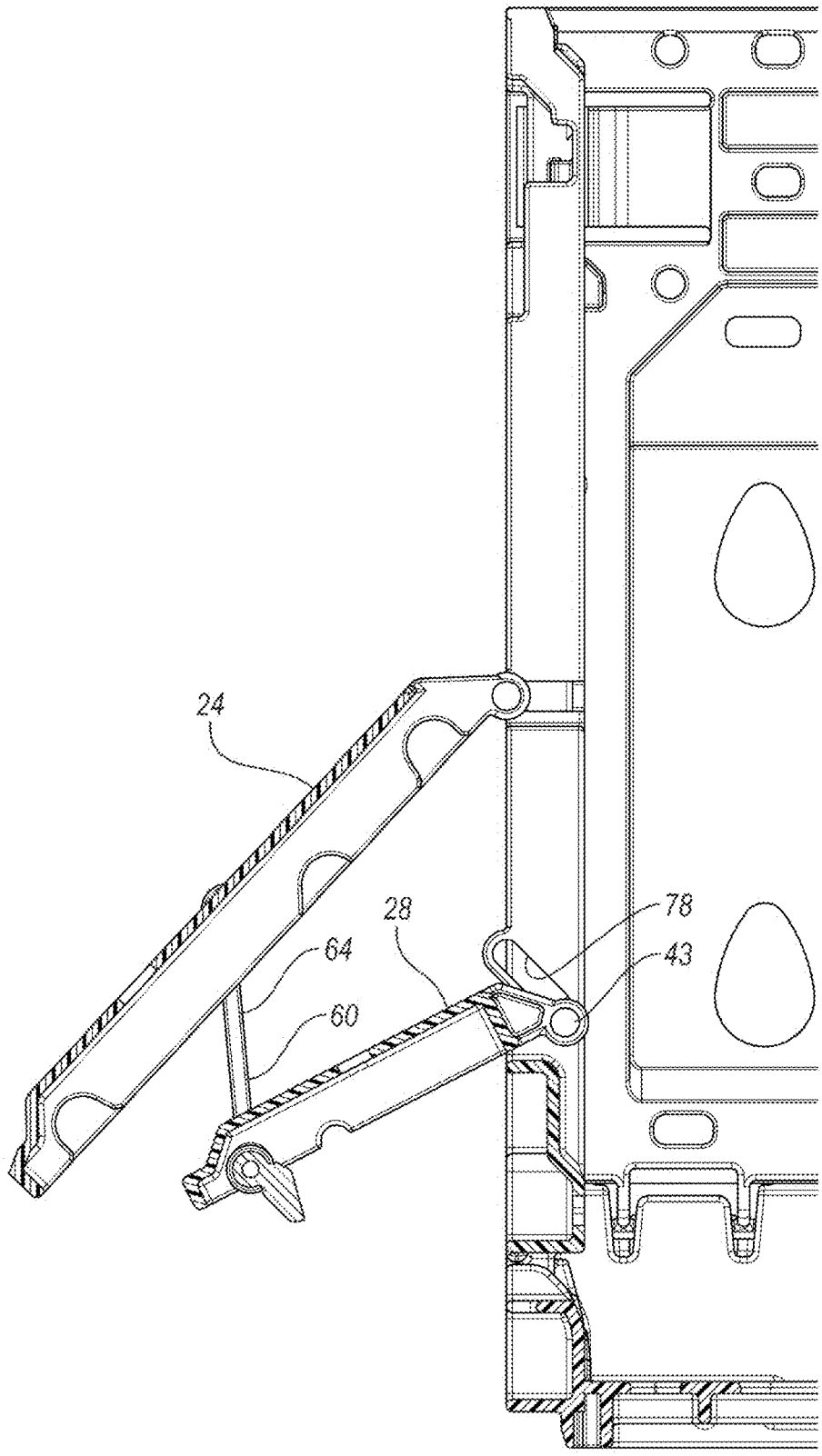

In FIGS. 21 and 22, the upper portion 24 is past horizontal.

Figure 23:
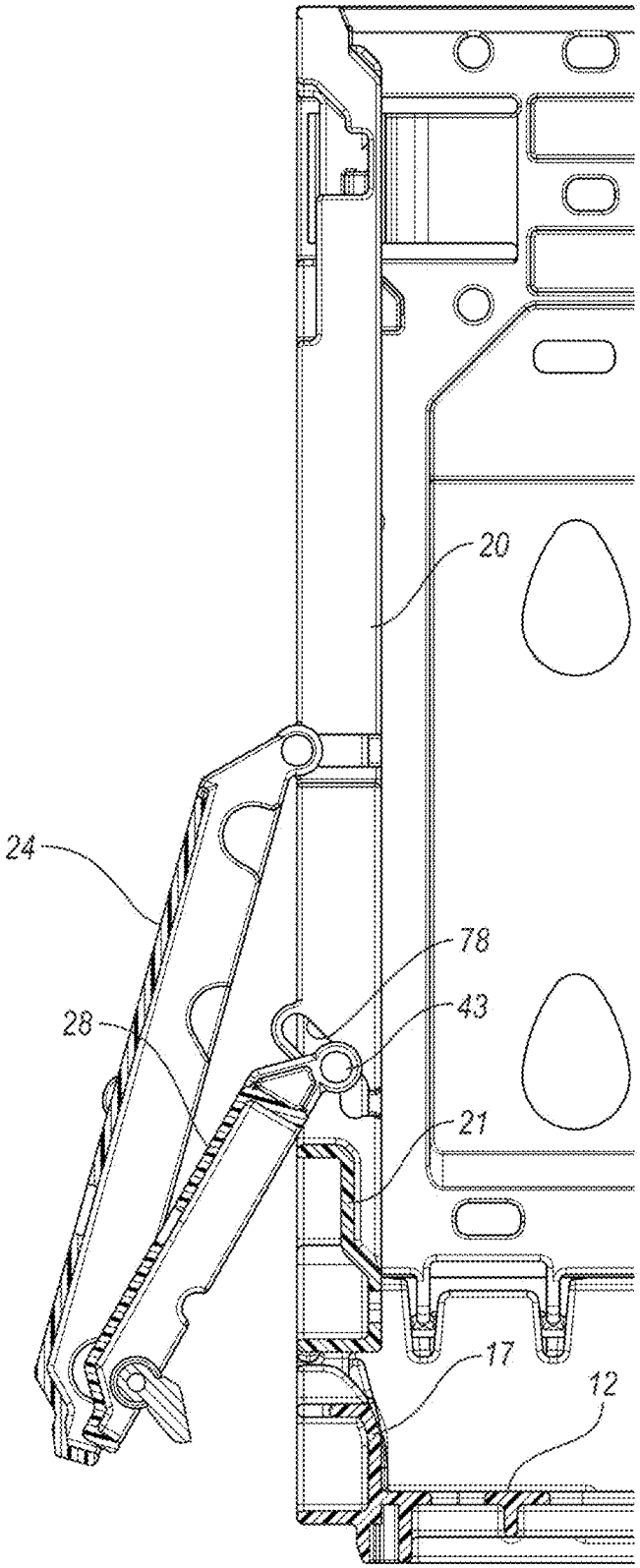

In FIG. 23 the lower portion 28 contacts the lower horizontal portion 21 of the frame 20. This causes the hinge pins 43 to start to pivot outward (forward toward the exterior) in the lower hinge receivers 78, which also lifts the lower portion 28 as the hinge pins 43 travel up the lower hinge receivers 78.

Figure 24:
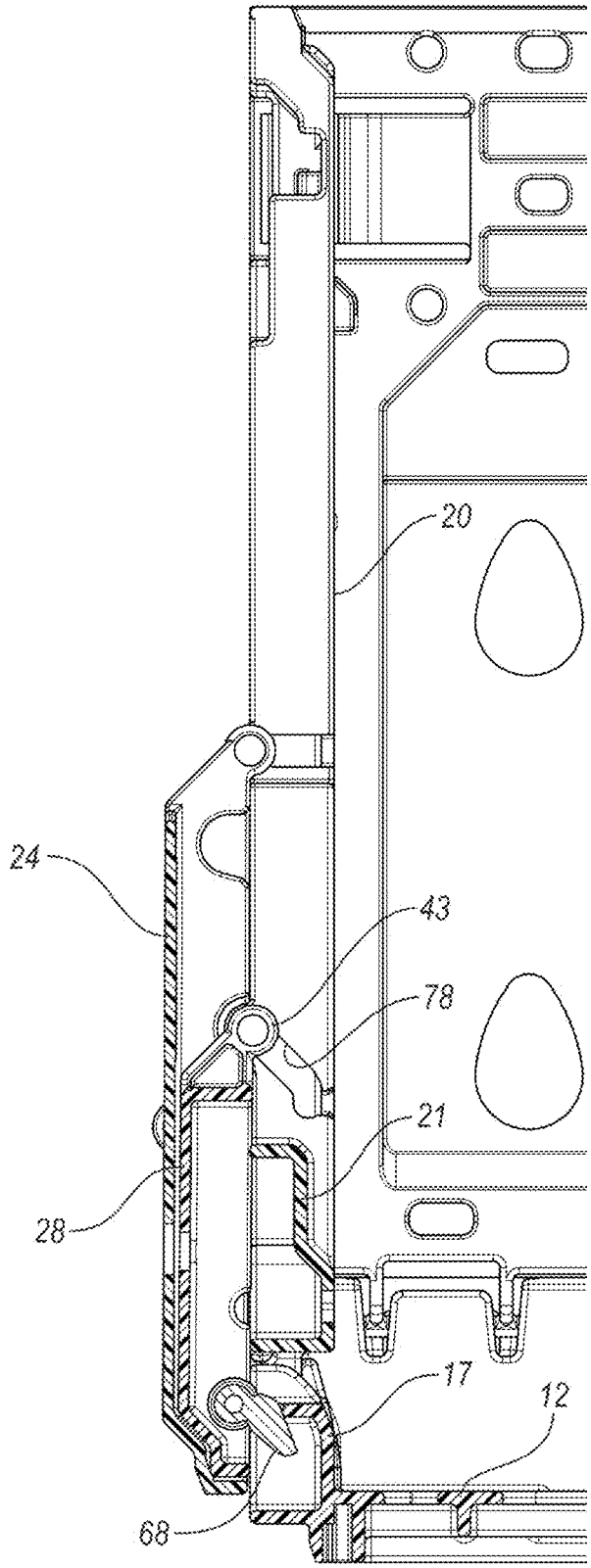
FIG. 24 shows the front wall of FIG. 15 fully retracted.
Figure 25:
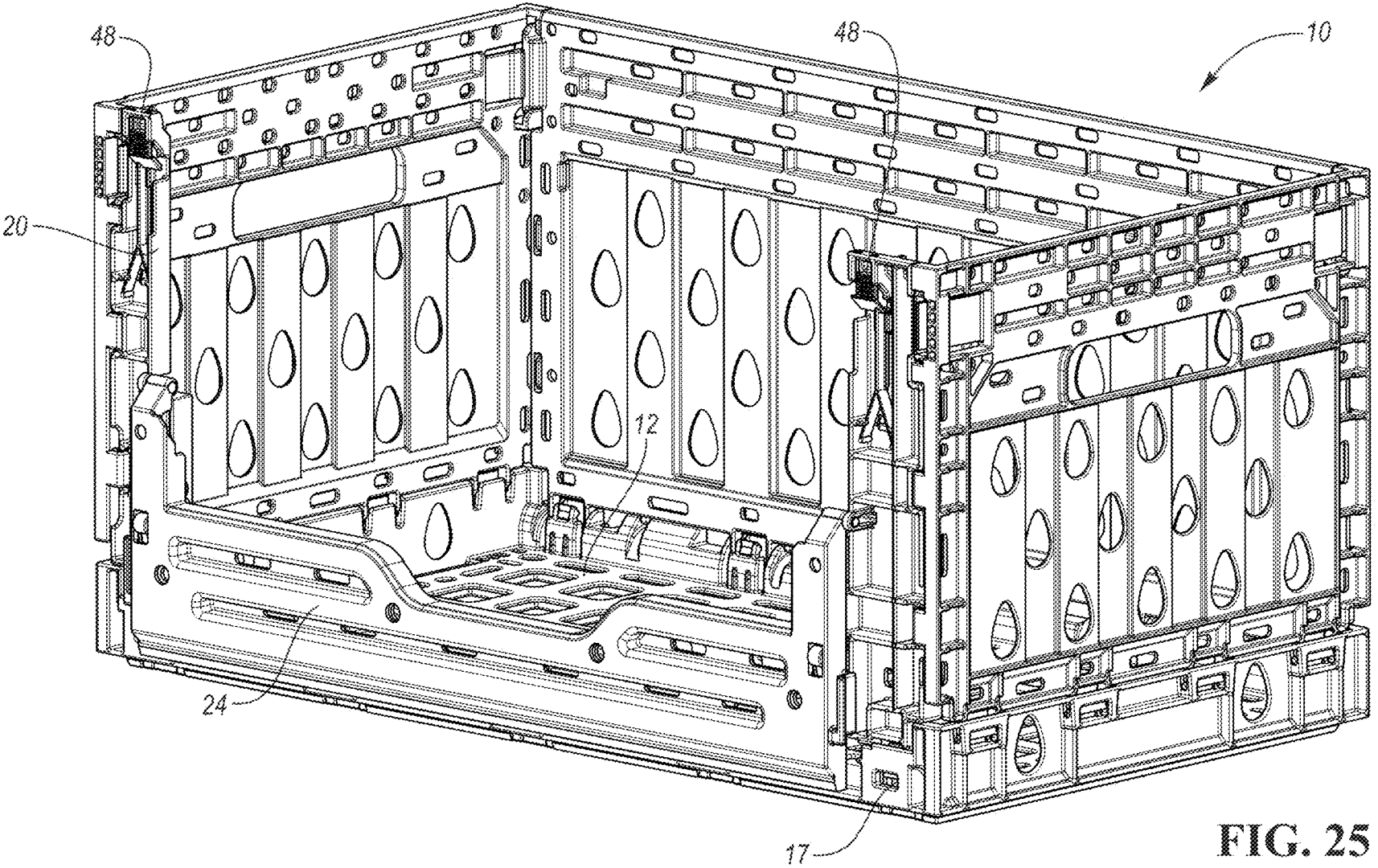
FIG. 25 is a perspective view of the container of FIG. 1 with the front wall fully retracted.

In FIG. 24, the hinge pins 43 are returned to the uppermost portions of the lower hinge receivers 78, which lifts the lower portion 28 sufficiently to be received within the cavity of the upper portion 24. The stop members 68 are also partially received within the flange 17 of the base 12, as shown in FIG. 24. In this manner, the upper portion 24 and lower portion 28 are nested within one another and flat against the front flange 17 of the base 12 and lower horizontal portion 21 of the frame 20, as shown in FIGS. 24 and 25.

As an additional, independent feature (i.e. it could be practiced with or without a retractable front wall), the hinges that connect the two overlapping walls (in this case, the front wall 18 and rear wall 14) are vertically translatable. By permitting vertical translation of the hinge, when the walls 14, 18 are collapsed, either one can be collapsed first with the other on top of the first, and both walls will be flat on the base 12. This reduces the overall height of the container 10 when it is empty and collapsed. This will be described in the subsequent figures.

Figure 26:
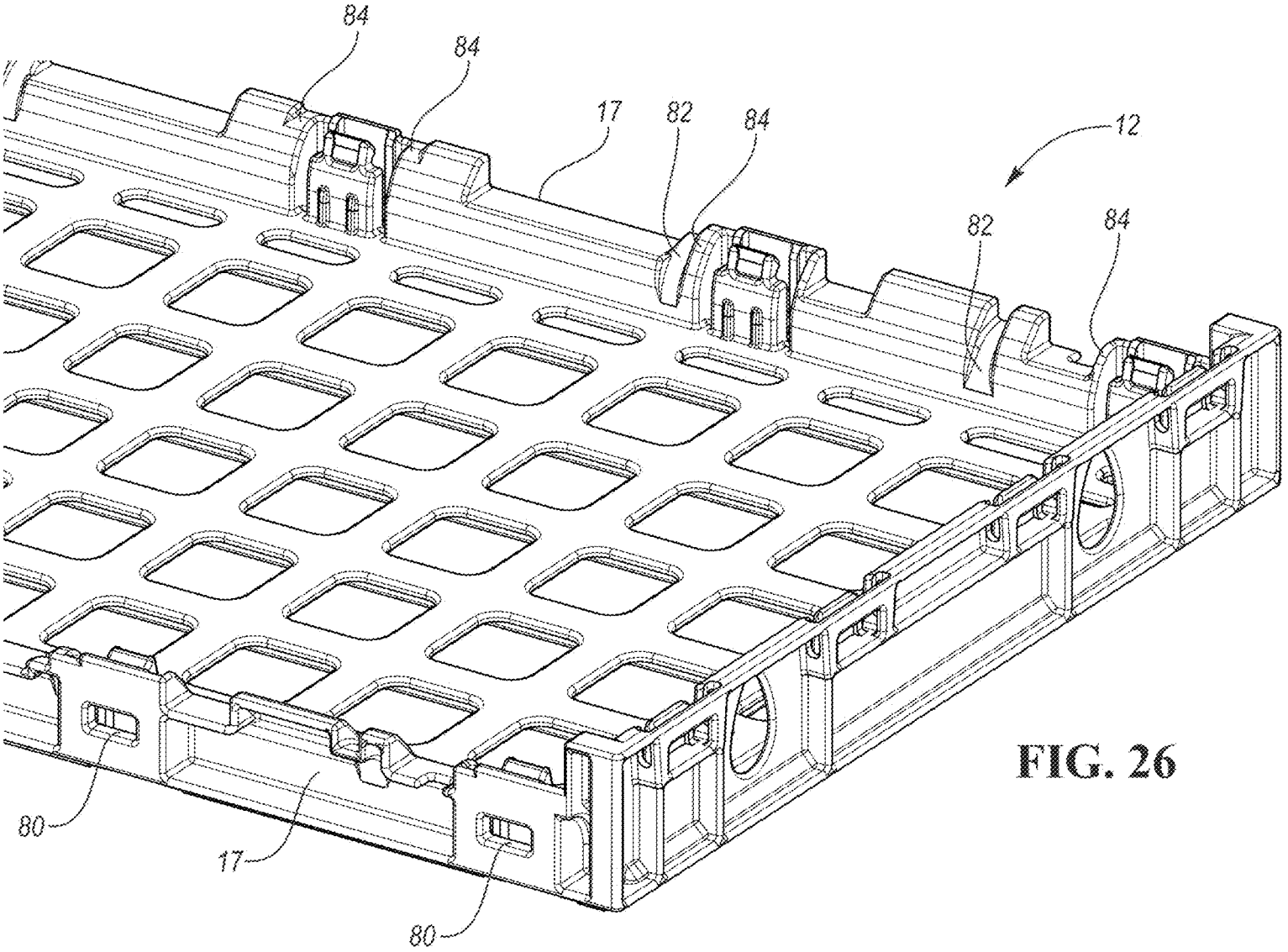
FIG. 26 shows a partial perspective view of the base of the container of FIG. 1.

FIG. 26 shows a partial view of the base 12. Front and rear flanges 17 include a plurality of each of three different cam surfaces. A first cam surface 80 is an upper surface formed by an opening through an outer wall of the flange 17. A second cam surface 82 is a convex surface starting on an inner surface of the flange 17 and continuing in a curved path upward and outward toward an outer wall of the flange 17. A third cam surface 84 is also a convex surface starting on an inner surface of the flange 17 and continuing in a curved path upward and outward toward an outer wall of the flange 17, but the third cam surface 84 has a larger radius and ends higher than the second cam surface 82. Again, there are a plurality of each of these cam surfaces 80, 82, 84 on each of the front and rear flanges 17. In the example shown, the front wall 18 and the rear wall 14 are connected to the front and rear flanges 17 in an identical manner.

Figure 27:
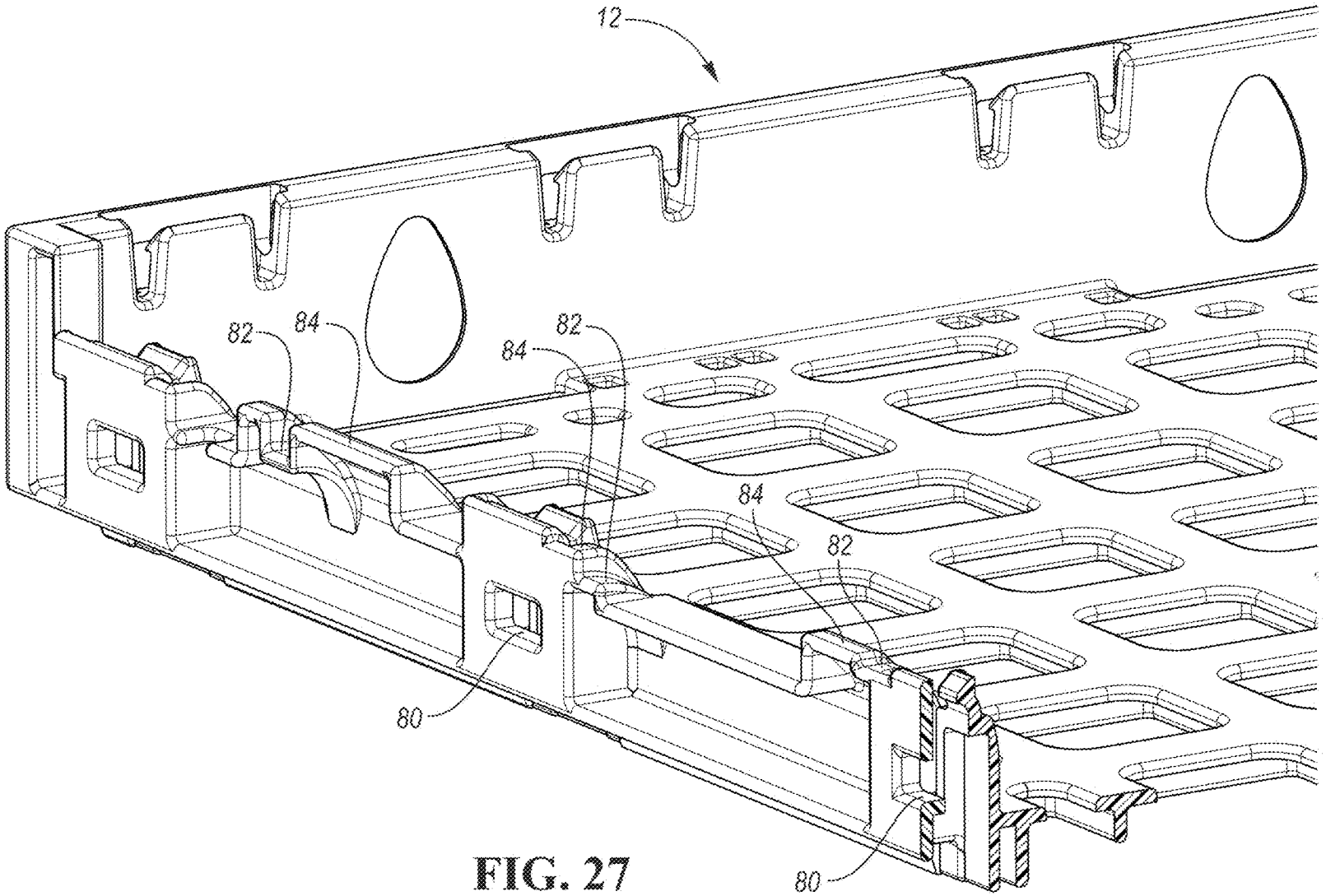
FIG. 27 is a perspective view of the base of FIG. 26 partially broken away through one of the first cam surfaces.
Figure 28:
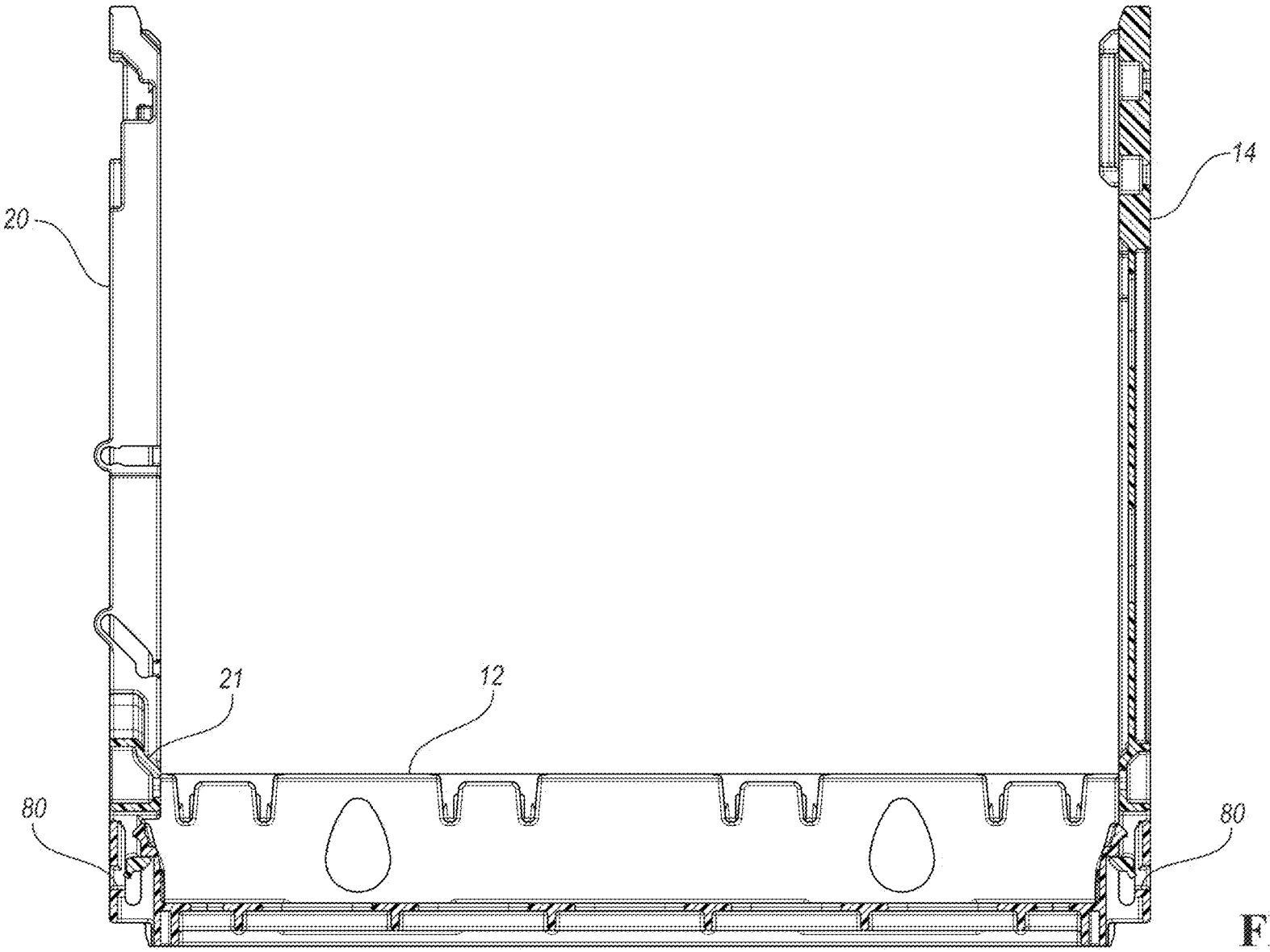
FIG. 28 is a section view through the front wall, rear wall and base, through two of the first came surfaces 80.

FIG. 27 is a perspective view of the base 12 partially broken away through one of the first cam surfaces 80. FIG. 28 is a section view through the front wall 18, rear wall 14 and base 12 of the container 10, again through two of the first cam surfaces 80.

Figure 29:
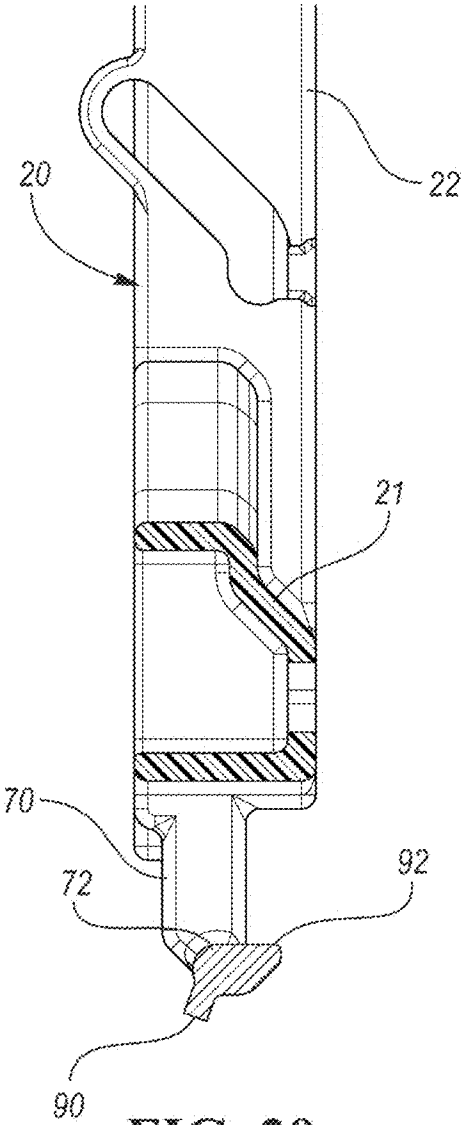
FIG. 29 is an enlarged section view of a lower portion of the frame.

FIG. 29 is an enlarged section view of a lower portion of the frame 20. The hinge pin 72 of each hinge member 70 includes a tongue 90 extending downward and angling outward (toward the exterior) slightly while the frame 20 is in the vertical position. The hinge member 70 further includes an inwardly projecting lobe 92, which is horizontal when the frame 20 is in the vertical position. Again, the rear wall 14 would be the same.

Figure 30:
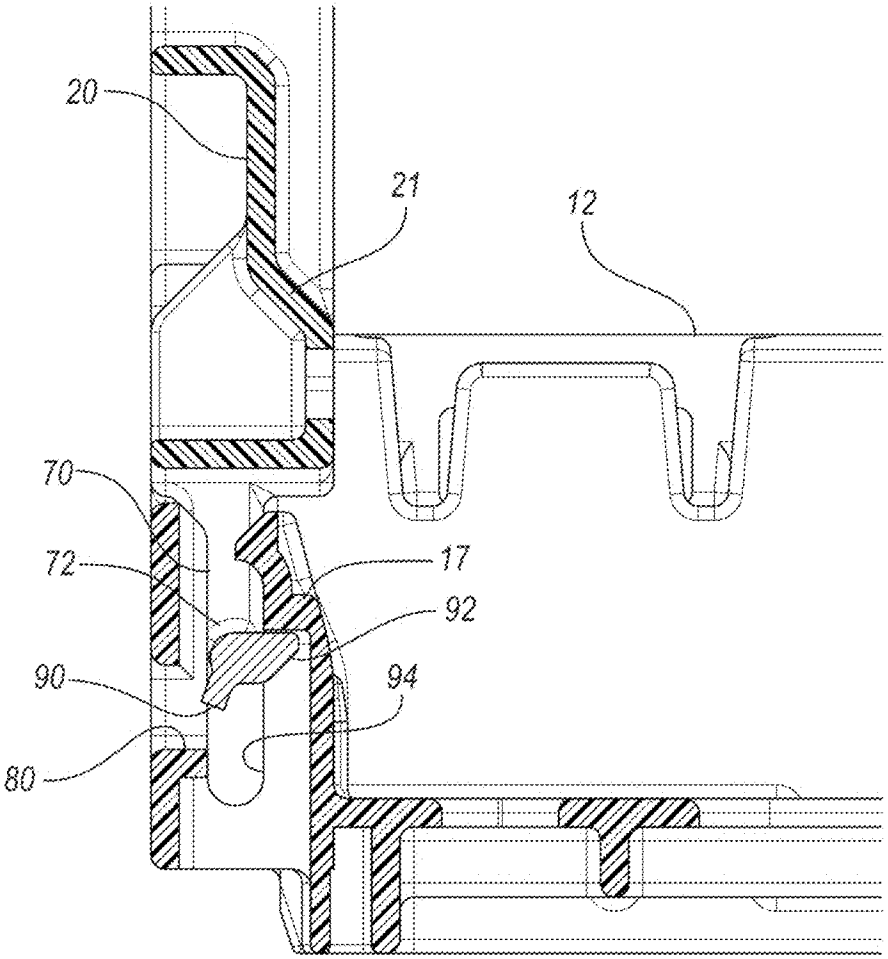
FIG. 30 shows the frame of FIG. 29 installed in the base.

FIG. 30 shows the frame 20 of FIG. 29 installed in the base 12. The hinge pin 72 is received in a vertical slot 94 within the flange 17 of the base 12. The first cam surface 80 is adjacent the slot 94. Again, the rear wall 14 would be the same.

Figure 31:
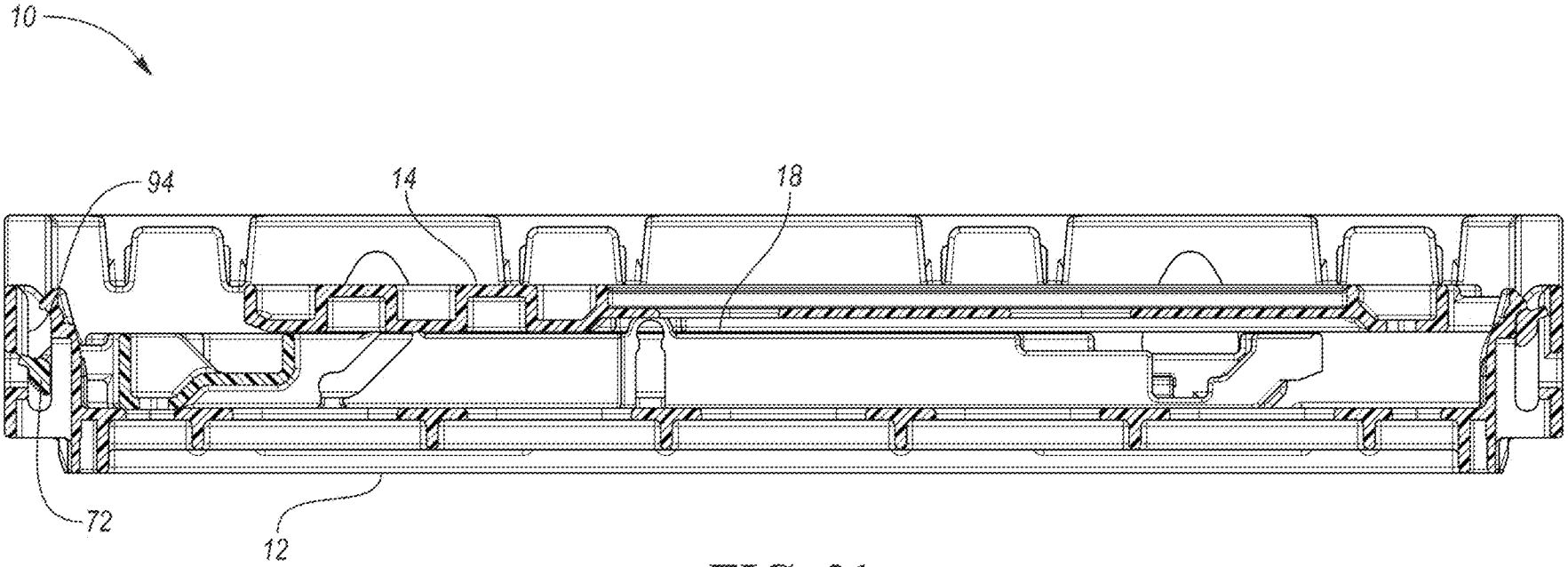
FIG. 31 is a section view of the container in a collapsed position with the rear wall on top of the front wall.
Figure 32:
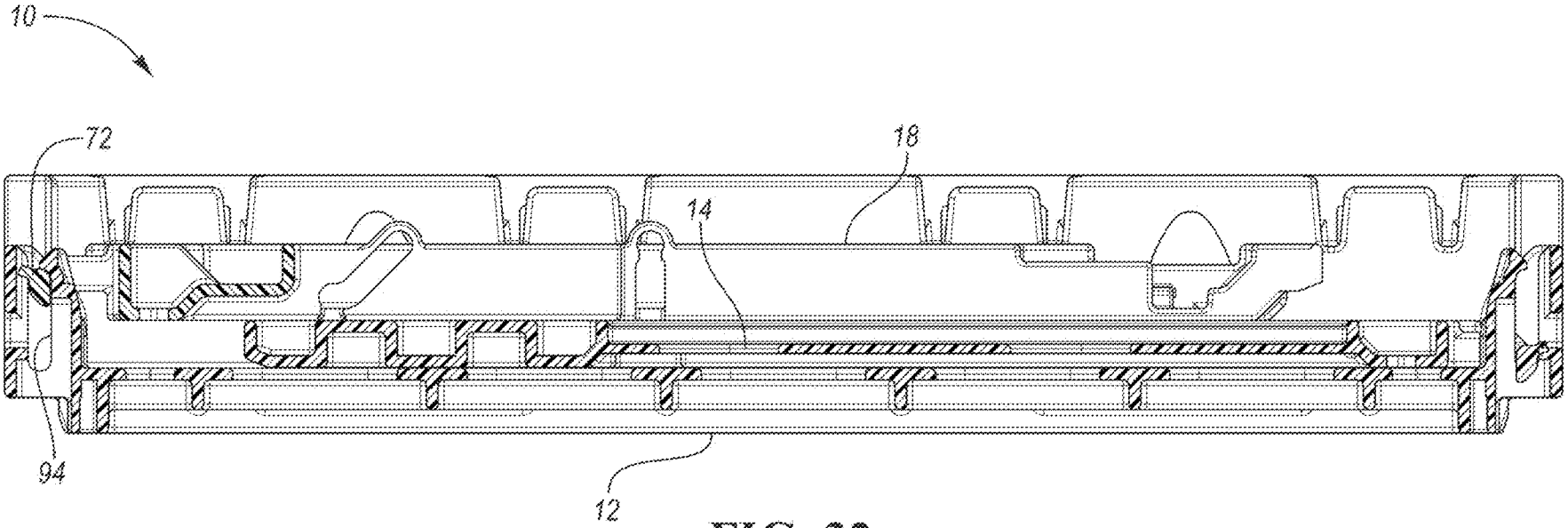
FIG. 32 is a section view of the container in the collapsed position with the front wall on top of the rear wall.

FIG. 31 is a section view of the container 10 in a collapsed position with the rear wall 14 on top of the front wall 18. FIG. 32 is a section view of the container in the collapsed position with the front wall 18 on top of the rear wall 14. In each, the hinge pin 72 of the upper wall slides to the top of the slot 94 and the hinge pin 72 of the lower wall slides to the bottom of the slot 94. In this manner, the walls 14, 18 both lie flat on the base 12 reducing the stacking height of the container 10 when it is empty.

The cam surfaces are engaged when moving the walls 14, 18 from the collapsed position to the upright position. It is desirable for the hinge pin 72 of the lower wall to be moved upward in the slot 94 without binding. Generally speaking, the three cam surfaces work sequentially to accomplish this smoothly.

Figure 33:
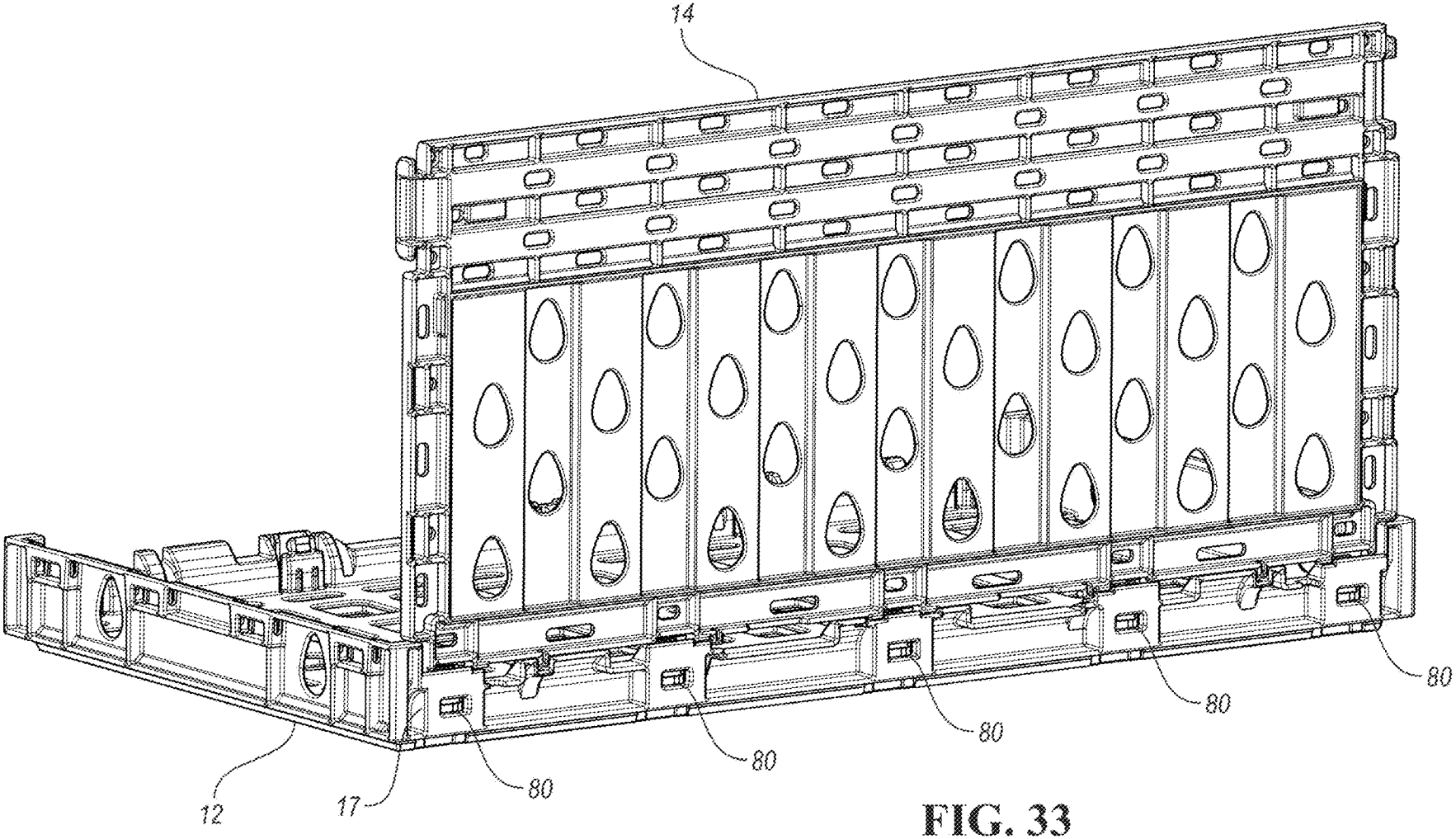
FIG. 33 is a perspective view of the base and rear wall of FIG. 1 identifying the first cam surfaces.
Figure 34:
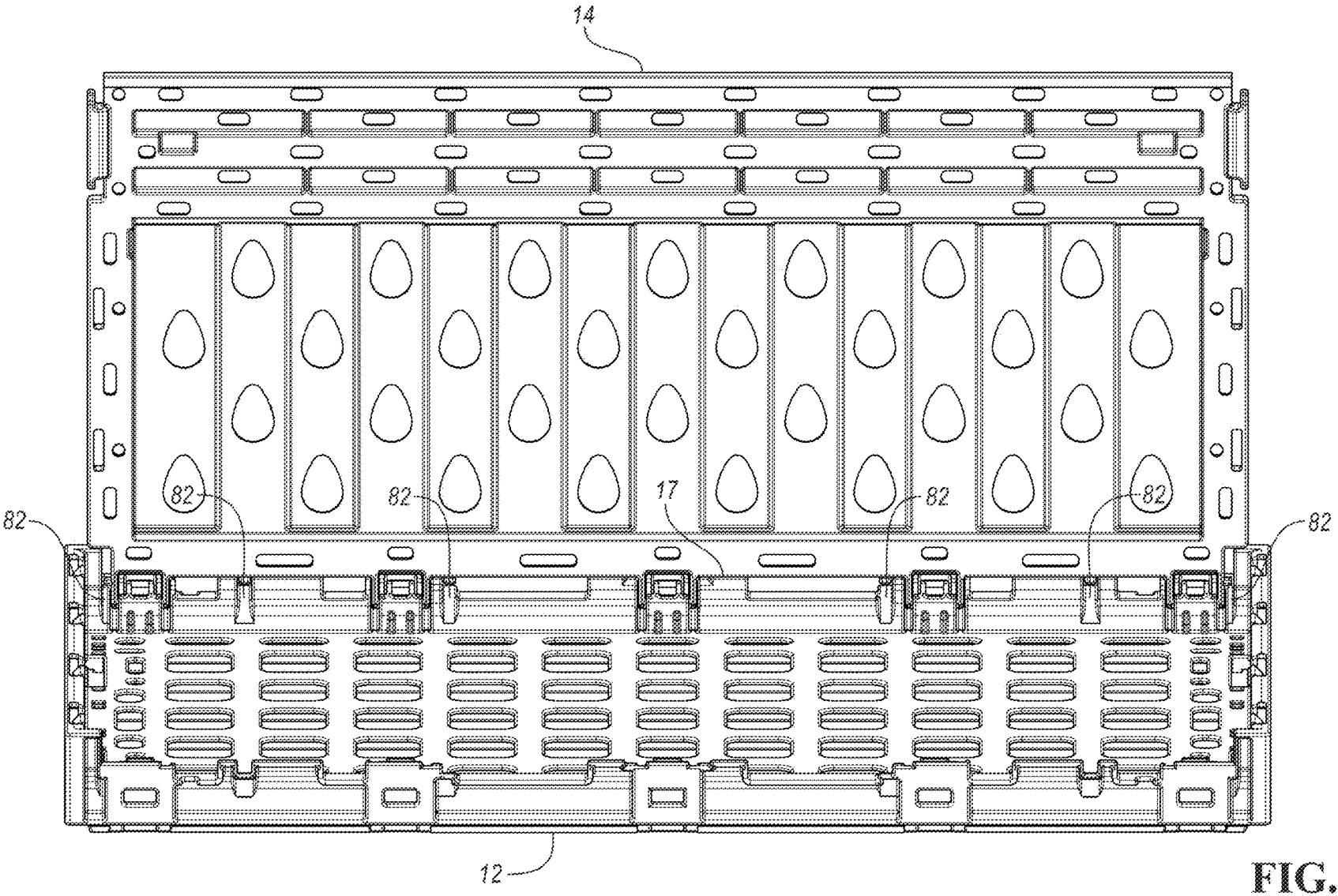
FIG. 34 shows the base and rear wall of FIG. 33 identifying the second cam surfaces.
Figure 35:
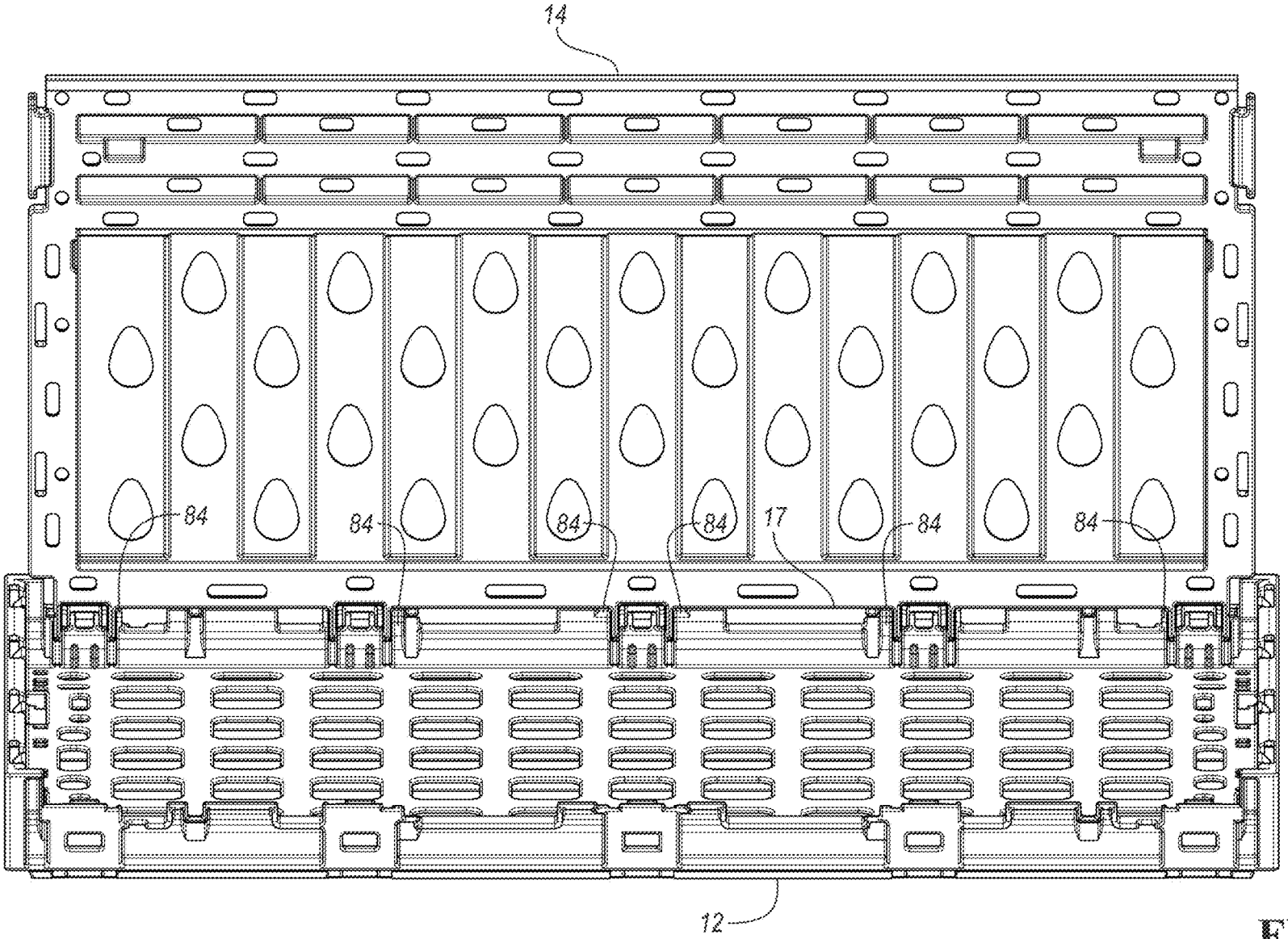
FIG. 35 shows the base and rear wall of FIG. 33 identifying the third cam surfaces 84.

FIG. 33 shows the first cam surfaces 80 in one of the flanges 17, but the other flange 17 is identical. FIG. 34 shows the second cam surfaces 82 in one of the flanges 17, but the other flange 17 is identical. FIG. 35 shows the third cam surfaces 84 in one of the flanges 17, but the other is identical.

Figure 36:
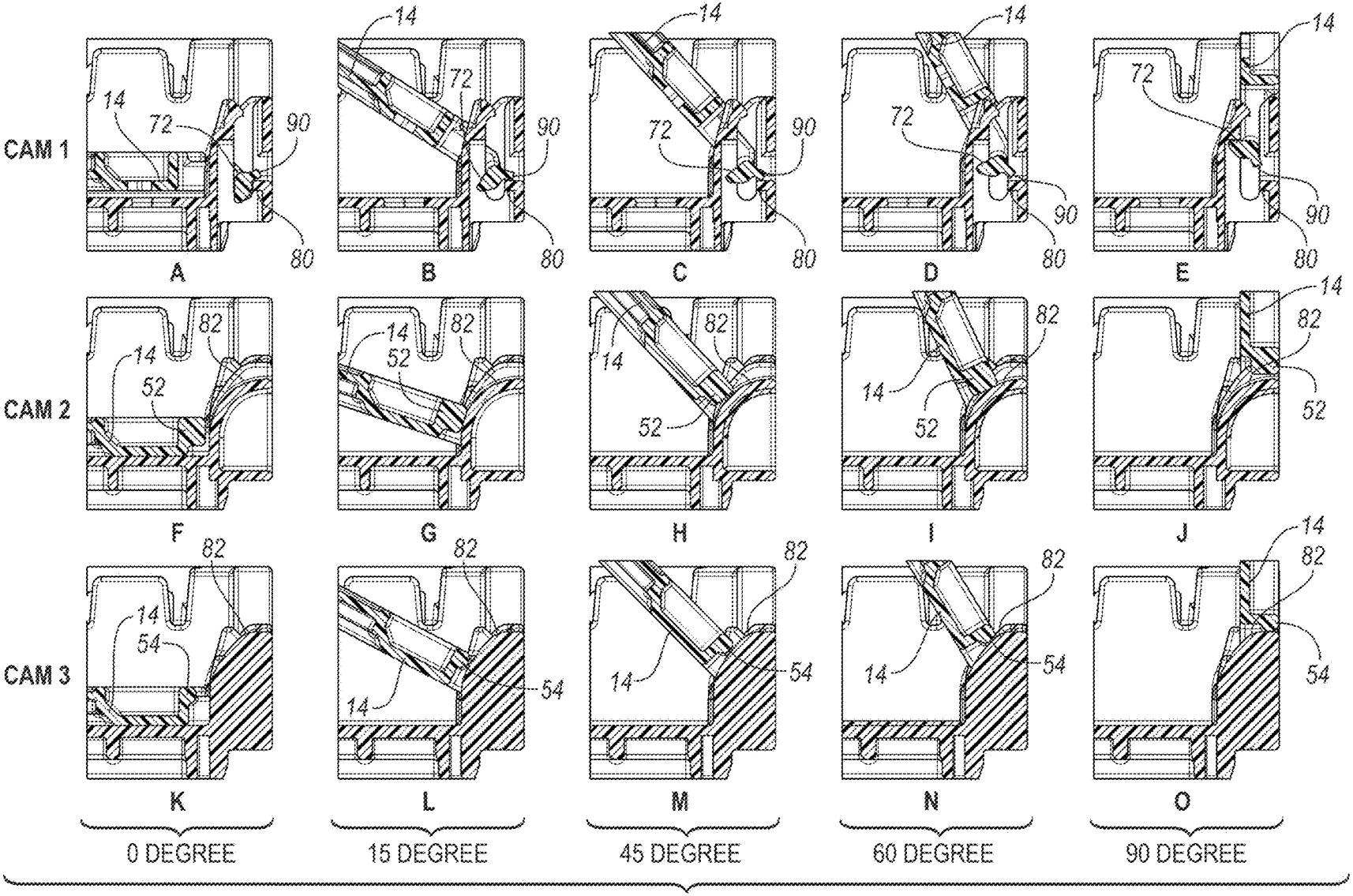
FIG. 36 shows each of the three cam surfaces in action during five phases of the wall moving from the horizontal to the upright position.

FIG. 36 shows section views A-O of each of the three cam surfaces in action during five phases of the wall moving from the horizontal to the upright position. Although illustrated with respect to the rear wall 14, the front wall 18 (more specifically, the frame 20) would operate identically. FIG. 36 shows the rear wall 14 moving from a position collapsed directly on the base 12 to the upright position because this is the movement where vertical translation would occur. Pivoting from a position collapsed on the front wall 18 would be substantially just a pivoting motion with little to no vertical translation (but the third cam surface 84 may contribute some vertical translation).

Referring to FIG. 36, only the first cam surface 80 is engaged by the first follower (tongue 90) during a first angular interval from about zero to about fifteen degrees (views A-B). As the wall 14 is pivoted to about fifteen degrees, the tongue 90 lifts the wall 14 leveraging on the first cam surface 80. In this first angular interval, the second cam surface 82 is not engaged by the second follower 52 (views F-G) and the third cam surface 84 is not engaged by the third follower 54 (views K-L).

Around forty-five degrees the second cam surface 82 is engaged by the second follower 52 on the underside of the wall 14 (view H), which further lifts the rear wall 14 vertically during this second angular interval between about forty-five degrees and sixty degrees (views H-I). The first cam surface 80 loses engagement with the first follower 90 as the rear wall 14 is lifted further (views C-D) and the third cam surface 84 has not yet been engaged by the third follower 54 (views M-N). Of course, some overlap in the intervals would occur such that there are small angular intervals where more than one cam surface is engaged by more than one follower (e.g. the first follower 90 may engage the first cam surface 80 for a small angular interval while the second follower 52 engages the second cam surface 82, and the second follower 52 may engage the second cam surface 82 for a small angular interval while the third follower 54 engages the third cam surface 84).

Between about sixty and about ninety degrees (a third angular interval), the third cam surface 84 is engaged by the third follower 54 on the underside of the rear wall 14 (views N-O), which completes lifting the rear wall 14 into place where it is supported. During the third angular interval, the second cam surface 82 loses engagement with the second follower 52 as the rear wall 14 is lifted further (I-J). The first follower 90 does not engage the first cam surface 80 during the third angular interval (views D-E).

As shown in FIGS. 9A, 10A, 26 and 33-35, there are a plurality of first followers 90, a plurality of second followers 52, and a plurality of third followers 54, each aligned with one of the first cam surfaces 80, one of the second cam surfaces 82, and one of the third cam surfaces 84, respectively.

Figure 37:
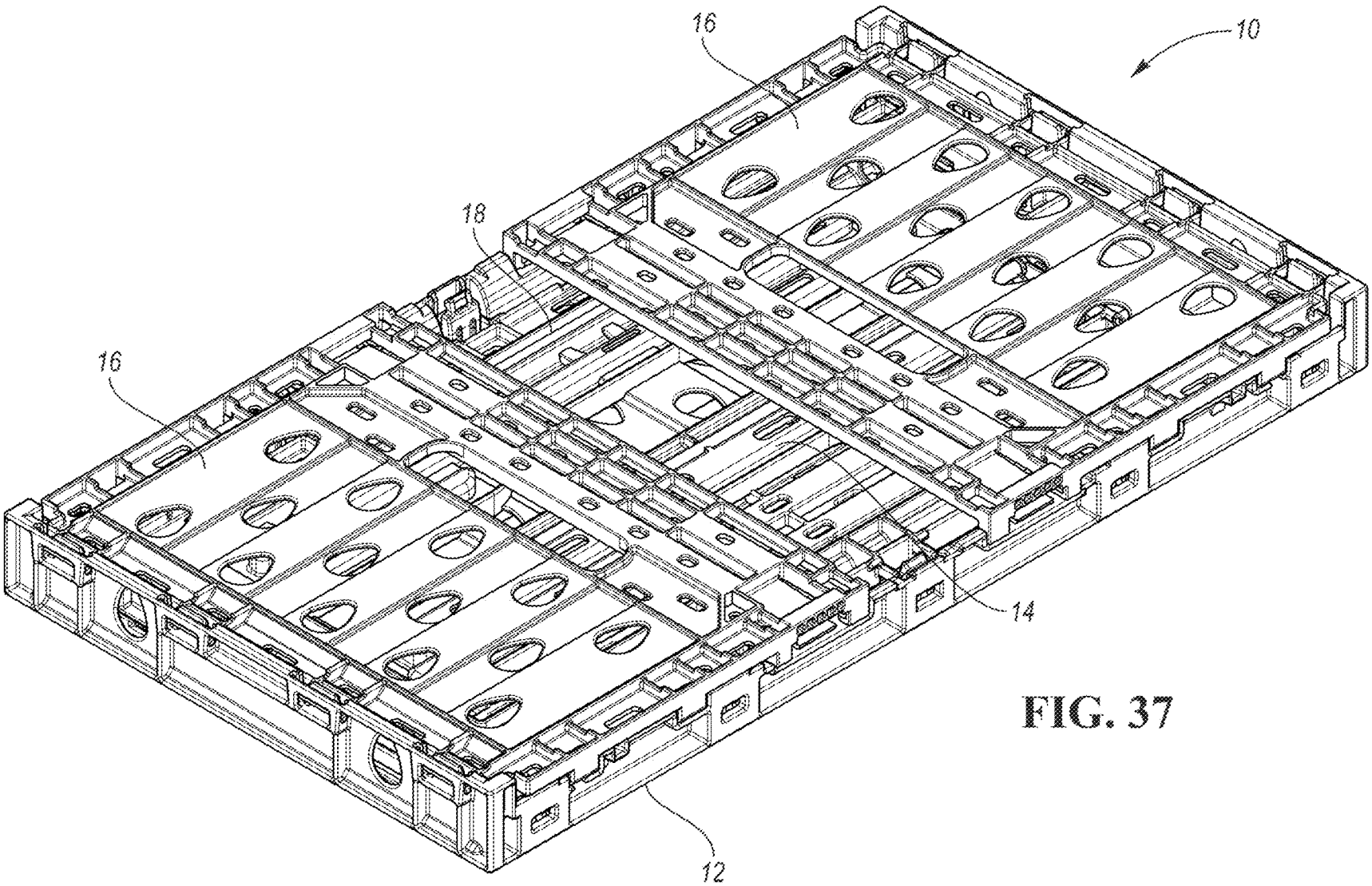
FIG. 37 is a perspective view of the container of FIG. 1 in the fully collapsed position.

FIG. 37 is a perspective view of the container 10 in the fully collapsed position. In FIG. 37, the front wall 18 is collapsed directly onto the base 12 and the rear wall 14 is collapsed onto the front wall 18, but as explained above, the rear wall 14 could be collapsed directly onto the base 12 with the front wall 18 collapsed onto the rear wall 14 and the walls 14, 18 would still be flat relative to the base 12. In either configuration, the end walls 16 are then collapsed onto the front wall 18 and rear wall 14, as shown.

Alternatively, it is possible to implement the cam surfaces on the bottom of the walls 14, 18 and the cam followers on the base 12.

Each of the components described above is preferably injection molded of a suitable plastic.

In accordance with the provisions of the patent statutes and jurisprudence, exemplary configurations described above are considered to represent a preferred embodiment of the invention. However, it should be noted that the invention can be practiced otherwise than as specifically illustrated and described without departing from its spirit or scope.

What is claimed is:

1. A collapsible container comprising:

a base;

a first wall pivotably connected to the base by a hinge, the first wall pivotable from a collapsed position on the base through a first angular interval and then through a second angular interval toward an upright position, the hinge permitting translation of the first wall toward and away from the base;

a first cam surface;

a first follower configured to contact the first cam surface during the first angular interval and to lift the first wall away from the base during movement of the first wall in the first angular interval toward the second angular interval;

a second cam surface; and a second follower configured to contact the second cam surface during the second angular interval and to lift the first wall away from the base during movement of the first wall in the second angular interval toward the upright position, wherein a pivot axis of the first wall is translated vertically relative to the base by the first cam surface and the second cam surface as it moves between the collapsed position on the base and the upright position.

2. The collapsible container of claim 1 wherein the first cam surface and the second cam surface are formed on the base and wherein the first follower and the second follower are formed on the first wall.

3. The collapsible container of claim 1 wherein the first wall includes a U-shaped frame having a lower horizontal portion pivotably connected to the base and a pair of vertical portions, the first wall further including an upper portion and a lower portion pivotably connected to the pair of vertical portions.

4. The collapsible container of claim 1 wherein a hinge pin of the first wall is translated away from the base by the first cam surface and the first follower during the first angular interval and by the second cam surface and the second follower during the second angular interval.

5. The collapsible container of claim 1 wherein the first follower is one of a plurality of first followers, wherein the second follower is one of a plurality of second followers, the first cam surface is one of a plurality of first cam surfaces, and the second cam surface is one of a plurality of second cam surfaces, wherein each of the plurality of first followers is configured to contact one of the plurality of first cam surfaces during the first angular interval, and wherein each of the plurality of second followers is configured to contact one of the plurality of second cam surfaces during the second angular interval.

6. The collapsible container of claim 5 wherein the hinge includes hinge pin pivotable and slidable vertically in a slot.

7. The collapsible container of claim 1 further including a pair of end walls pivotably connected to the base, wherein the pair of end walls are pivotable between an upright position and a collapsed position on the first wall, and wherein each of the pair of end walls includes a handle opening therethrough.

8. A collapsible container comprising:

a base;

a first wall pivotably connected to the base by a hinge, the first wall pivotable from a collapsed position on the base through a first angular interval and then through a second angular interval toward an upright position, the hinge permitting translation of the first wall toward and away from the base;

a first cam surface;

a first follower configured to contact the first cam surface during the first angular interval and to lift the first wall away from the base during movement of the first wall in the first angular interval toward the second angular interval;

a second cam surface; and a second follower configured to contact the second cam surface during the second angular interval and to lift the first wall away from the base during movement of the first wall in the second angular interval toward the upright position, wherein the first follower does not contact the first cam surface during at least a portion of the second angular interval.

9. The collapsible container of claim 8 wherein the first wall is pivotable through a third angular interval between the collapsed position and the upright position and wherein the collapsible container further includes a third cam surface and a third follower, and wherein the third follower is configured to contact the third cam surface during the third angular interval and to lift the first wall away from the base during the third angular interval.

10. The collapsible container of claim 8 wherein a pivot axis of the first wall is translated vertically relative to the base by the first cam surface and the second cam surface as it moves between the collapsed position on the base and the upright position.

11. A collapsible container comprising:

a base;

a first wall pivotably connected to the base by a hinge and pivotable through first, second and third angular intervals between a collapsed position on the base and an upright position, the hinge permitting translation of the first wall toward and away from the base;

a first cam surface;

a first follower configured to contact the first cam surface during the first angular interval and to lift the first wall away from the base during the first angular interval, wherein the first follower does not contact the first cam surface during at least a portion of the second angular interval;

a second cam surface;

a second follower configured to contact the second cam surface during the second angular interval and to lift the first wall away from the base during the second angular interval wherein the second follower does not contact the second cam surface during at least a portion of the third angular interval;

a third cam surface; and a third follower configured to contact the third cam surface during the third angular interval and to lift the first wall away from the base during the third angular interval.

12. The collapsible container of claim 11 wherein when the first wall is moved from the collapsed position to the upright position, the first wall moves through the first angular interval, then through the second angular interval, and then through the third angular interval.

13. The collapsible container of claim 12 wherein the first wall is translated away from the base by the first cam surface, then by the second cam surface, and then by the third cam surface as it moves from the collapsed position on the base toward the upright position.

14. The collapsible container of claim 13 wherein a hinge pin of the first wall is translated away from the base by the first cam surface, the second cam surface, and the third cam surface as it moves between the collapsed position on the base and the upright position.

15. The collapsible container of claim 14 wherein the first follower is one of a plurality of first followers, wherein the second follower is one of a plurality of second followers, the third follower is one of a plurality of third followers, the first cam surface is one of a plurality of first cam surfaces, the second cam surface is one of a plurality of second cam surfaces, and the third cam surface is one of a plurality of third cam surfaces, wherein each of the plurality of first followers is configured to contact one of the plurality of first cam surfaces during the first angular interval, wherein each of the plurality of second followers is configured to contact one of the plurality of second cam surfaces during the second angular interval, and wherein each of the plurality of third followers is configured to contact one of the plurality of third cam surfaces during the third angular interval.

16. The collapsible container of claim 15 wherein the hinge includes hinge pin pivotable and slidable vertically in a slot.

17. The collapsible container of claim 16 further including a second wall pivotably connected to the base opposite the first wall, wherein the second wall is translatable vertically relative to the base, the collapsible container further including a pair of end walls pivotably connected to the base, wherein the pair of end walls are pivotable between an upright position and a collapsed position on the first wall and the second wall.

18. A collapsible container comprising:

a base;

a first wall pivotably connected to the base by a hinge, the first wall pivotable from a collapsed position on the base through a first angular interval, then through a second angular interval, then through a third angular interval to an upright position, the hinge permitting translation of the first wall toward and away from the base;

a first cam surface;

a first follower configured to contact the first cam surface during the first angular interval and to lift the first wall away from the base during the first angular interval;

a second cam surface;

a second follower configured to contact the second cam surface during the second angular interval and to lift the first wall away from the base during the second angular interval;

a third cam surface; and a third follower, wherein the third follower is configured to contact the third cam surface during the third angular interval and to lift the first wall away from the base during the third angular interval.

19. The collapsible container of claim 18 wherein the first cam surface and the second cam surface are formed on the base and wherein the first follower and the second follower are formed on the first wall.

20. The collapsible container of claim 19 wherein the first follower does not contact the first cam surface during at least a portion of the second angular interval.

21. The collapsible container of claim 20 wherein the second follower does not contact the second cam surface during at least a portion of the third angular interval.

22. The collapsible container of claim 18 wherein the first follower is one of a plurality of first followers, the second follower is one of a plurality of second followers, the third follower is one of a plurality of third followers, the first cam surface is one of a plurality of first cam surfaces, the second cam surface is one of a plurality of second cam surfaces, and the third cam surface is one of a plurality of third cam surfaces, wherein each of the plurality of first followers is configured to contact one of the plurality of first cam surfaces during the first angular interval, wherein each of the plurality of second followers is configured to contact one of the plurality of second cam surfaces during the second angular interval, and wherein each of the plurality of third followers is configured to contact one of the plurality of third cam surfaces during the third angular interval.

23. The collapsible container of claim 22 wherein the hinge includes hinge pin pivotable and slidable vertically in a slot.

24. The collapsible container of claim 18 further including a pair of end walls pivotably connected to the base, wherein the pair of end walls are pivotable between an upright position and a collapsed position on the first wall, and wherein each of the pair of end walls includes a handle opening therethrough.

25. A collapsible container comprising:

a base;

a first wall pivotably connected to the base by a hinge, the first wall pivotable from a collapsed position on the base through a first angular interval, then through a second angular interval, then through a third angular interval to an upright position, the hinge permitting translation of the first wall toward and away from the base;

a plurality of first cam surfaces formed on the base;

a plurality of first followers formed on the first wall and configured to contact the plurality of first cam surfaces during the first angular interval and to lift the first wall away from the base during the first angular interval;

a plurality of second cam surfaces formed on the base; and a plurality of second followers formed on the first wall and configured to contact the plurality of second cam surfaces during the second angular interval and to lift the first wall away from the base during the second angular interval.

26. The collapsible container of claim 25 wherein the hinge includes hinge pin pivotable and slidable vertically in a slot.

27. The collapsible container of claim 26 further including a pair of end walls pivotably connected to the base, wherein the pair of end walls are pivotable between an upright position and a collapsed position on the first wall, and wherein each of the pair of end walls includes a handle opening therethrough.

* * * * *